US008754839B2

(12) United States Patent
Koyama

(10) Patent No.: US 8,754,839 B2
(45) Date of Patent: Jun. 17, 2014

(54) METHOD FOR DRIVING DISPLAY DEVICE

(75) Inventor: Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 204 days.

(21) Appl. No.: 13/286,289

(22) Filed: Nov. 1, 2011

(65) Prior Publication Data

US 2012/0113086 A1 May 10, 2012

(30) Foreign Application Priority Data

Nov. 5, 2010 (JP) ..... 2010-248017

(51) Int. Cl.
*G09G 3/36* (2006.01)

(52) U.S. Cl.
USPC ..... 345/100

(58) Field of Classification Search
USPC ..... 345/100, 87, 98–99
See application file for complete search history.

(56) References Cited

U.S. PATENT DOCUMENTS

| | | | |
|---|---|---|---|
| 5,731,856 | A | 3/1998 | Kim et al. |
| 5,744,864 | A | 4/1998 | Cillessen et al. |
| 6,294,274 | B1 | 9/2001 | Kawazoe et al. |
| 6,563,174 | B2 | 5/2003 | Kawasaki et al. |
| 6,727,522 | B1 | 4/2004 | Kawasaki et al. |
| 6,727,875 | B1 * | 4/2004 | Mikami et al. ..... 345/92 |
| 7,049,190 | B2 | 5/2006 | Takeda et al. |
| 7,061,014 | B2 | 6/2006 | Hosono et al. |
| 7,064,346 | B2 | 6/2006 | Kawasaki et al. |
| 7,105,868 | B2 | 9/2006 | Nause et al. |
| 7,211,825 | B2 | 5/2007 | Shih et al |
| 7,282,782 | B2 | 10/2007 | Hoffman et al. |
| 7,297,977 | B2 | 11/2007 | Hoffman et al. |

(Continued)

FOREIGN PATENT DOCUMENTS

| | | |
|---|---|---|
| EP | 1 737 044 A1 | 12/2006 |
| EP | 2 226 847 A2 | 9/2010 |

(Continued)

OTHER PUBLICATIONS

Toshio Kamiya; "Carrier Transport Properties and Electronic Structures of Amorphous Oxide Semiconductors: The resent status"; Solid State Physics; Sep. 1, 2009; pp. 621-633; vol. 44, No. 9 (with English abstract and full English translation).

(Continued)

*Primary Examiner* — Chanh Nguyen
*Assistant Examiner* — Roy Rabindranath
(74) *Attorney, Agent, or Firm* — Fish & Richardson P.C.

(57) ABSTRACT

A method for driving a display device in which characteristics of a transistor including an oxide semiconductor can approximately be recovered to characteristics before deterioration is provided. In the method for driving the display device, by which images are displayed with the use of a plurality of frame periods, the display device is driven so that a voltage of 20 V or higher can be applied to a gate of a transistor, which is a driving element, for 1 millisecond or longer in a period, in which any one of scan lines is selected, in each frame period. For a plurality of frame periods, the rows are selected so that a voltage of 20 V or higher is applied to gates of all of the transistors which are driving elements for 1 millisecond or longer, whereby characteristics of the transistor can approximately be recovered to characteristics before deterioration.

15 Claims, 14 Drawing Sheets

(56) References Cited

U.S. PATENT DOCUMENTS

| | | | | |
|---|---|---|---|---|
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,674,650 | B2 | 3/2010 | Akimoto et al. | |
| 7,732,819 | B2 | 6/2010 | Akimoto et al. | |
| 7,777,713 | B2 * | 8/2010 | Hashimoto et al. | 345/100 |
| 7,791,072 | B2 | 9/2010 | Kumomi et al. | |
| 2001/0046027 | A1 | 11/2001 | Tai et al. | |
| 2002/0056838 | A1 | 5/2002 | Ogawa | |
| 2002/0132454 | A1 | 9/2002 | Ohtsu et al. | |
| 2003/0169220 | A1 * | 9/2003 | Tsuchiya et al. | 345/84 |
| 2003/0189401 | A1 | 10/2003 | Kido et al. | |
| 2003/0218222 | A1 | 11/2003 | Wager, III et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0062705 | A1 * | 3/2005 | Yamada | 345/94 |
| 2005/0168426 | A1 * | 8/2005 | Moon et al. | 345/98 |
| 2005/0199959 | A1 | 9/2005 | Chiang et al. | |
| 2006/0012593 | A1 * | 1/2006 | Iriguchi et al. | 345/204 |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0296568 | A1 | 12/2008 | Ryu et al. | |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0185082 | A1 * | 7/2009 | Hashimoto | 348/739 |
| 2009/0278122 | A1 | 11/2009 | Hosono et al. | |
| 2009/0280600 | A1 | 11/2009 | Hosono et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2010/0295041 | A1 | 11/2010 | Kumomi et al. | |

FOREIGN PATENT DOCUMENTS

| | | | |
|---|---|---|---|
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | A | 5/1999 |
| JP | 2000-044236 | A | 2/2000 |
| JP | 2000-150900 | A | 5/2000 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2006-165528 | A | 6/2006 |
| WO | 2004/114391 | A1 | 12/2004 |

OTHER PUBLICATIONS

Masashi Tsubuku et al.; "Photo-Current Response and Negative Bias Stability Under Light Irradiation in IGZO-TFT"; IDW '10 : Proceedings of the 17th International Display Workshops; 2010; pp. 1841-1844.

Takayuki Inoue et al.; "Anomalous Photocurrent Characteristic at Negative Gate Bias in IGZO TFT": IDW '10 : Proceedings of The 17th International Display Workshops; 2010, pp. 751-754.

Asakuma, N. et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.

Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.

Clark, S et al., "First Principles Methods Using CASTEP," Zeitschrift fur Kristallographie, 2005, vol. 220, pp. 567-570.

Coates. D et al., Optical Studies of the Amorphous Liquid-Cholesteric Liquid Crystal Transition: The "Blue Phase," Physics Letters, Sep. 10, 1973, vol. 45A, No. 2, pp. 115-116.

Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.

Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.

(56) References Cited

OTHER PUBLICATIONS

Fortunato, E et al., "Wide-Bandgap High-Mobility ZnO Thin-Film Transistors Produced at Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In-Ga-Zn-O TFTs for Flat Panel Displays," AM-FPD '08 Digest of Technical Papers, Jul. 2, 2008, pp. 251-252, The Japan Society of Applied Physics.
Godo, H et al., "P-9: Numerical Analysis on Temperature Dependence of Characteristics of Amorphous In-Ga-Zn-Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In-Ga-Zn-Oxide TFT," AM-FPD '09 Digest of Technical Papers, Jul. 1, 2009, pp. 41-44.
Hayashi, R et al., "42.1: Invited Paper: Improved Amorphous In-Ga-Zn-O TFTS," SID Digest '08 : SID International Symposium Digest of Technical Papers, May 20, 2008, vol. 39, pp. 621-624.
Hirao, T et al., "Novel Top-Gate Zinc Oxide Thin-Film Transistors (ZnO TFTS) for AMLCDS," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda., T et al., "Full-Functional System Liquid Crystal Display Using CG-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N et al., "Spinel,YBFE2O4, and YB2FE3O7 Types of Structures for Compounds in the IN2O3 and SC2O3-A2O3-BO Systems [A; Fe, Ga, or Al; B: Mg, Mn, Fe, Ni, Cu,or Zn] at Temperatures Over 1000°C," Journal of Solid State Chemistry, 1985, vol. 60, pp. 382-384.
Kimizuka, N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3-ZnGa2O4-ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98. pp. 045501-1-045501-4.
Lee, H et al.. "Current Status of, Challenges to, and Perspective View of AM-OLED," IDW '06 : Proceedings of the 13th International Display Workshops, Dec. 7, 2006, pp. 663-666.
Lee, J et al., "World's Largest (15-inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09 : SID International Symposium Digest of Technical Papers, May 31, 2009, pp. 191-193.
Li, C et al. "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "SUFTLA Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW '08 : Proceedings of The 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3-Ga2ZnO4-ZnO system at 1350°C," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.
Nowatari, H et al., "60.2: Intermediate Connector With Suppressed Voltage Loss for White Tandem OLEDS," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.

(56) References Cited

OTHER PUBLICATIONS

Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 in. QVGA AMOLED Display Using In-Ga-Zn-Oxide TFTS With a Novel Passivation Layer," SID Digest '09 : SID International Symposium Digest of Technical Papers, May 31, 2009, pp. 284-287.
Ohara, H et al., "Amorphous In-Ga-Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al., "15.2: Development of Driver-Integrated Panel using Amorphous In-Ga-Zn-Oxide TFT," SID Digest '09 : SID International Symposium Digest of Technical Papers, May 31, 2009, pp. 184-187.
Osada, T et al., "Development of Driver-Integrated Panel Using Amorphous In-Ga-Zn-Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park, J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium-Gallium-Zinc Oxide TFTS and Their Application for Large Size AMOLED," AM-FPD '08 Digest of Technical Papers, Jul. 2, 2008, pp. 275-278.
Park, S et al., "Challenge to Future Displays: Transparent AM-OLED Driven by PEALD Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-in. AMOLED Display With Driver Circuit Using Amorphous In-Ga-Zn-Oxide TFTS," IDW '09 : Proceedings of the 16th International Display Workshops, 2009, pp. 689-692.
Son, K et al., "42.4L: Late-News Paper: 4 inch QVGA AMOLED Driven by the Threshold Voltage Controlled Amorphous GIZO (Ga2O3-In2O3-ZnO) TFT," SID Digest '08 : SID International Symposium Digest of Technical Papers, May 20, 2008, vol. 39, pp. 633-636.
Takahashi, M et al., "Theoretical Analysis of IGZO Transparent Amorphous Oxide Semiconductor," IDW '08 : Proceedings of the 15th International Display Workshops, Dec. 3, 2008, pp. 1637-1640.
Tsuda, K et al., "Ultra Low Power Consumption Technologies for Mobile TFT-LCDs," IDW '02 : Proceedings of The 9th International Display Workshops, Dec. 4, 2002, pp. 295-298.
Ueno, K et al., "Field-Effect Transistor on SrTiO3 With Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.

* cited by examiner

FIG. 14A application time: 500ms
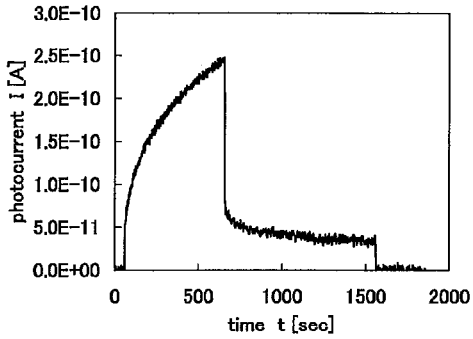
FIG. 14B application time: 100ms
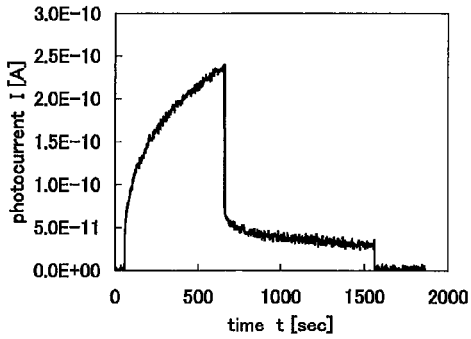
FIG. 14C application time: 10ms
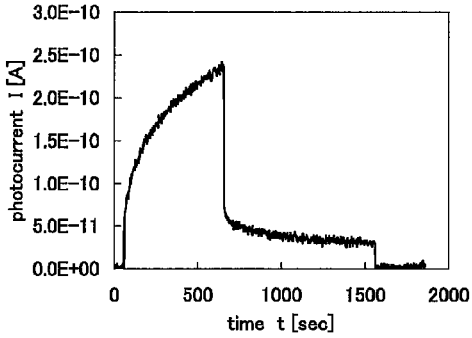
FIG. 14D application time: 1ms
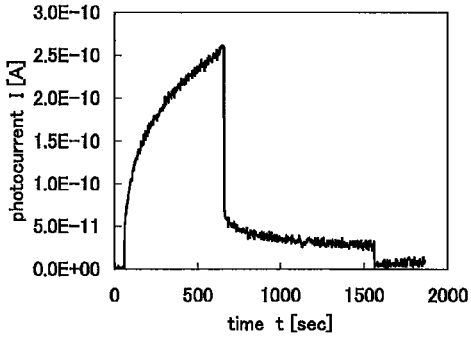
FIG. 14E application time: 100 $\mu$ s
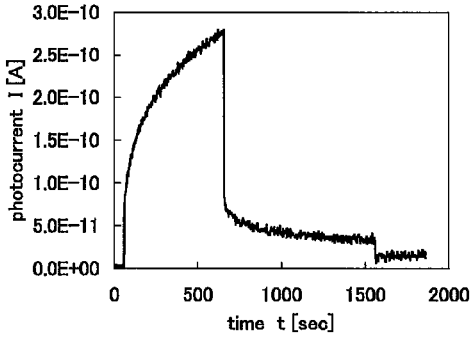
FIG. 14F application time: 10 $\mu$ s
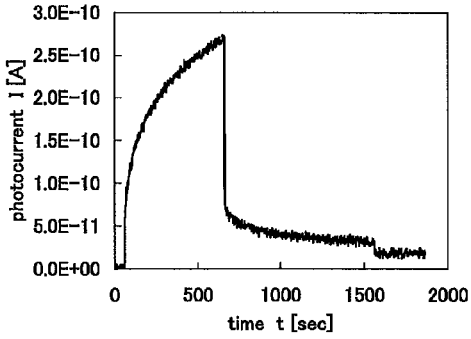

METHOD FOR DRIVING DISPLAY DEVICE

BACKGROUND OF THE INVENTION

1. Field of the Invention

The present invention relates to a method for driving a display device. The present invention relates to a method for driving a display device including a plurality of pixels each of which has a transistor whose semiconductor layer includes an oxide semiconductor.

2. Description of the Related Art

A display device including a transistor using amorphous silicon as a driving element for display elements such as liquid crystal is widely used in commercial products such as a monitor of a computer and a television set. A manufacturing technique of a transistor using amorphous silicon has been already established and a liquid crystal panel with more than 60 inches has been produced.

Since operation speed of a transistor using amorphous silicon is slow and any further high performance cannot be expected, a thin film transistor using polysilicon has been developed. However, a crystallization step is required for forming polysilicon, which leads to cause variation in transistor characteristics and inhibits enlargement of a panel area.

In contrast, an oxide semiconductor material has been attracting attention as a transistor material besides a silicon-based material. As a material of the oxide semiconductor, a material including zinc oxide as its component is known. For example, Patent Document 1 discloses the configuration which employs a transistor including an amorphous oxide (oxide semiconductor) having an electron carrier concentration of lower than $10^{18}/cm^3$ as a driving element of a display device.

[Reference]

[Patent Document 1] Japanese Published Patent Application No. 2006-165528

SUMMARY OF THE INVENTION

However, a transistor including an oxide semiconductor has instable electrical characteristics, and the characteristics of the transistor unfortunately change depending on an external environment. Specifically, when negative bias is applied to a gate of a transistor including an oxide semiconductor while the transistor is irradiated with light with a wavelength of 400 nm or less, deterioration in characteristics such as shift of threshold voltage is caused.

An object of an embodiment of the present invention is to provide a method for driving a display device, by which characteristics of a transistor can approximately be recovered to characteristics before deterioration; the transistor is used as a driving element of the display device and which has an oxide semiconductor as a semiconductor layer.

An embodiment of the present invention provides the following driving method of a display device: in a transistor whose threshold voltage has been changed by applying negative bias to a gate while irradiating light with a wavelength of 400 nm or less, a voltage of 20 V or higher is applied to the gate for 1 millisecond or longer, so that the transistor has a threshold voltage that is substantially the same as the threshold voltage before the change. Specifically, in the method for driving the display device, by which images are displayed with the use of a plurality of frame periods, the display device is driven so that a voltage of 20 V or higher can be applied to a gate of a transistor, which is a driving element, for 1 millisecond or longer in a period, in which any one of scan lines is selected, in each frame period. For a plurality of frame periods, the rows are selected so that a voltage of 20 V or higher is applied to gates of all of the transistors which are driving elements for 1 millisecond or longer, whereby characteristics of the transistor can approximately be recovered to characteristics before deterioration.

An embodiment of the present invention is method for driving a display device, in which image display is performed by controlling an image signal supplied to pixels by using scan lines and signal lines in frame periods, including steps of selecting a first scan line in a first selection period and selecting scan lines including a second scan line, which is other than the first scan line, in a second selection period, in a first frame period; and selecting the second scan line in a first selection period and selecting scan lines including the first scan line, which is other than the second scan line, in a second selection period, in a second frame period. The first selection period and the second selection period are periods in which a high-level potential is applied to a gate of a transistor including an oxide semiconductor, which is provided a pixel. The first selection period is longer than the second selection period.

An embodiment of the present invention is a method for driving a display device, in which image display is performed by controlling an image signal supplied to pixels by using scan lines and signal lines in frame periods, including steps of selecting a first scan line in a first selection period and selecting scan lines including a second scan line, which is other than the first scan line, in a second selection period, in a first frame period; and selecting the second scan line in a first selection period and selecting scan lines including the first scan line, which is other than the second scan line, in a second selection period, in a second frame period. The first selection period and the second selection period are periods in which a high-level potential is applied to a gate of a transistor including an oxide semiconductor, which is provided in a pixel. In the first selection period, the signal line electrically connected to the transistor is supplied with an image signal having a low-level potential. The first selection period is longer than the second selection period.

In an embodiment of the present invention, a display element electrically connected to the transistor may be a liquid crystal element.

In an embodiment of the present invention, a plurality of scan lines may be selected in the first selection period.

According to an embodiment of the present invention, a method for driving a display device, by which characteristics of the transistor can approximately be recovered to characteristics before deterioration; the transistor is used as a driving element of the display device and which has an oxide semiconductor as a semiconductor layer can be provided.

BRIEF DESCRIPTION OF THE DRAWINGS

FIGS. 9A1, 9A2, and 9B are diagrams illustrating Embodiment 4.

FIGS. 14A to 14F are graphs illustrating Example 1.

DETAILED DESCRIPTION OF THE INVENTION

Figure 1A:
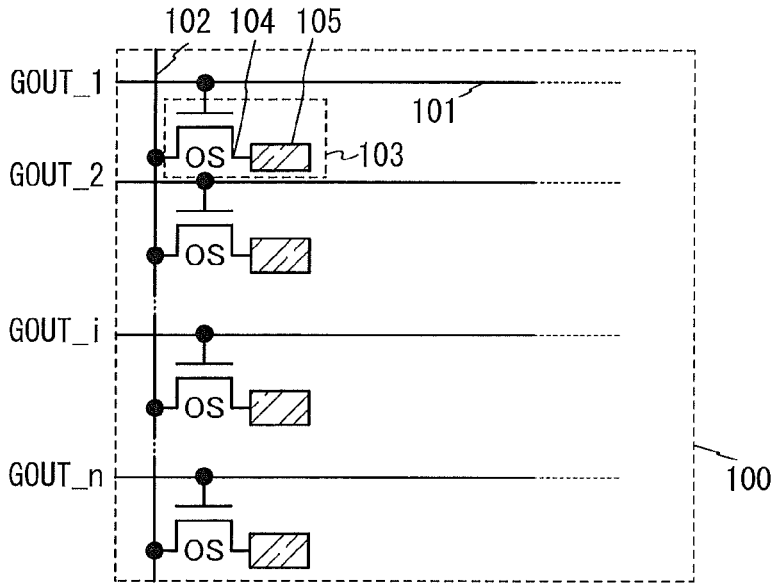
FIGS. 1A and 1B are diagrams illustrating Embodiment 1.

Embodiments and an example of the present invention will be hereinafter described with reference to the accompanying drawings. However, the embodiments can be implemented with various modes. It will be readily appreciated by those skilled in the art that modes and details can be changed in various ways without departing from the spirit and scope of the present invention. Accordingly, the present invention is not construed as being limited to the described content of the embodiments and an example included herein. Note that in structures of the invention described below, the same portions or portions having similar functions are denoted by the same reference numerals, and description thereof is not repeated.

Note that as for some components shown in some of the drawings, etc. for the embodiments, the size, the layer thickness, distortion in signal waveforms, and the region are exaggerated for purposes of clarity. Therefore, embodiments of the present invention are not limited to such scales.

Note that terms such as "first", "second", and "third" in this specification are used in order to avoid confusion among components, and the terms do not limit the components numerically.

(Embodiment 1)

First, FIG. 1A illustrates a simple circuit configuration of a display portion (also referred to as a pixel portion) of a display device.

FIG. 1A illustrates a circuit configuration of a pixel to which an image signal is supplied. FIG. 1A illustrates a scan line (gate line) 101, a signal line (data line) 102, a pixel 103, a transistor 104, and a display element 105, in a display portion 100. Note that in the following description, it is assumed that n scan lines (n is a natural number of 2 or more) and in signal lines (in is a natural number of 2 or more) are provided in the display portion 100 so that conduction states of the transistors 104 in the plurality of pixels 103 can be controlled.

The scan line 101 is a wiring for selecting the pixels 103, which are provided in matrix in the display portion 100, at once in a row direction. Specifically, the scan line 101 is connected to a gate of the transistor 104 and controls a conduction state between a source and a drain of the transistor in accordance with the potential applied to the gate. Note that in FIG. 1A, scan lines of the first row, the second row, the i-th row (i is a natural number of n or less), and the n-th row are referred to as GOUT_1, GOUT_2, GOUT_i, and GOUT_n, respectively.

The signal line 102 is a wiring for supplying image signals to the display elements 105 of the pixels 103 arranged in matrix in the display portion 100. Specifically, the signal line 102 is connected to a first terminal of the transistor 104, which corresponds to one of the source and the drain of the transistor 104, and supplies an image signal to a second terminal of the transistor 104, which corresponds to the other of the source and the drain of the transistor 104, in accordance with the conduction state of the transistor 104. Then, in the display element 105, gray scale is controlled.

The pixels 103 arranged in matrix in the display portion 100 are connected to the scan line 101 and the signal line 102. As a configuration example, the pixel 103 is provided beside an intersection of the scan line 101 and the signal line 102. Note that the pixels 103 are not necessarily provided in matrix in the display portion 100. For example, the pixels 103 may be arranged in zigzags with the scan line 101 and/or the signal line 102 meandering.

Note that a pixel corresponds to a display unit controlling the luminance of one color component (e.g., any one of R (red), G (green), and B (blue)). Therefore, in a color display device, the minimum display unit of a color image is composed of three pixels of an R pixel, a G pixel and a B pixel. Note that the color of the color elements is not necessarily of three varieties and may be of three or more varieties or may include a color other than RGB.

The transistor 104 is a transistor in which an oxide semiconductor is used for a semiconductor layer. The gate of the transistor 104 is connected to the scan line 101, the first terminal of the transistor 104 is connected to the signal line 102, and the second terminal of the transistor 104 is connected to the display element 105.

Note that in the drawings, "OS" beside a transistor denotes that an oxide semiconductor is used for a semiconductor layer.

As the oxide semiconductor, a four-component metal oxide such as an In—Sn—Ga—Zn—O-based oxide semiconductor; a three-component metal oxide such as an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, and a Sn—Al—Zn—O-based oxide semiconductor; a two-component metal oxide such as an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, an In—Mg—O-based oxide semiconductor; an In—Ga—O-based oxide semiconductor; an In—O-based oxide semiconductor; a Sn—O-based oxide semiconductor; or a Zn—O-based oxide semiconductor be used. In this specification, for example, an In—Sn—Ga—Zn—O-based oxide semiconductor means a metal oxide including indium (In), tin (Sn), gallium (Ga), and zinc (Zn), whose stoichiometric composition ratio is not particularly limited. The above oxide semiconductor may include silicon.

Alternatively, oxide semiconductors can be represented by the chemical formula, $InMO_3(ZnO)_m$ (m>0). Here, M represents one or more metal elements selected from Ga, Al, Mn, and Co.

It is preferable to form the oxide semiconductor film by a method with which impurities such as hydrogen, water, hydroxyl group, or hydride do not easily enter the oxide semiconductor film. The oxide semiconductor film can be formed by sputtering or the like, for example.

Note that a transistor is an element having at least three terminals of a gate, a drain, and a source. The transistor includes a channel region between a drain region and a source region, and current can flow through the drain region, the channel region, and the source region. Here, since the source and the drain of the transistor may change depending on the structure, the operating condition, and the like of the transistor, it is difficult to define which is a source or a drain. Thus, in this specification, a region functioning as a source and a drain may not be called the source or the drain. In such a case, one of the source and the drain is referred to as one terminal and the other thereof is referred to as the other terminal in some cases.

A transistor in a pixel may be an inverted-staggered transistor or a staggered transistor. Alternatively, a double-gate structure may be used in which a channel region is divided into a plurality of regions and the divided channel regions are connected in series. Alternatively, a dual-gate structure may be used in which gate electrodes are provided over and under the channel region. Further, the transistor element may be used in which a semiconductor layer is divided into a plurality of island-shaped semiconductor layers and which realizes switching operation.

An example of the display element 105 is an element which controls transmission or non-transmission of light; for example, a liquid crystal element may be used. As the display element 105, other than the liquid crystal element, for example, a MEMS (micro electro mechanical systems) element may be used. Note that the display element 105 may have a structure in which a storage capacitor is provided in addition to a liquid crystal element. In addition, as the display element 105, a self-light emitting element such as an EL element may be used.

Figure 1B:
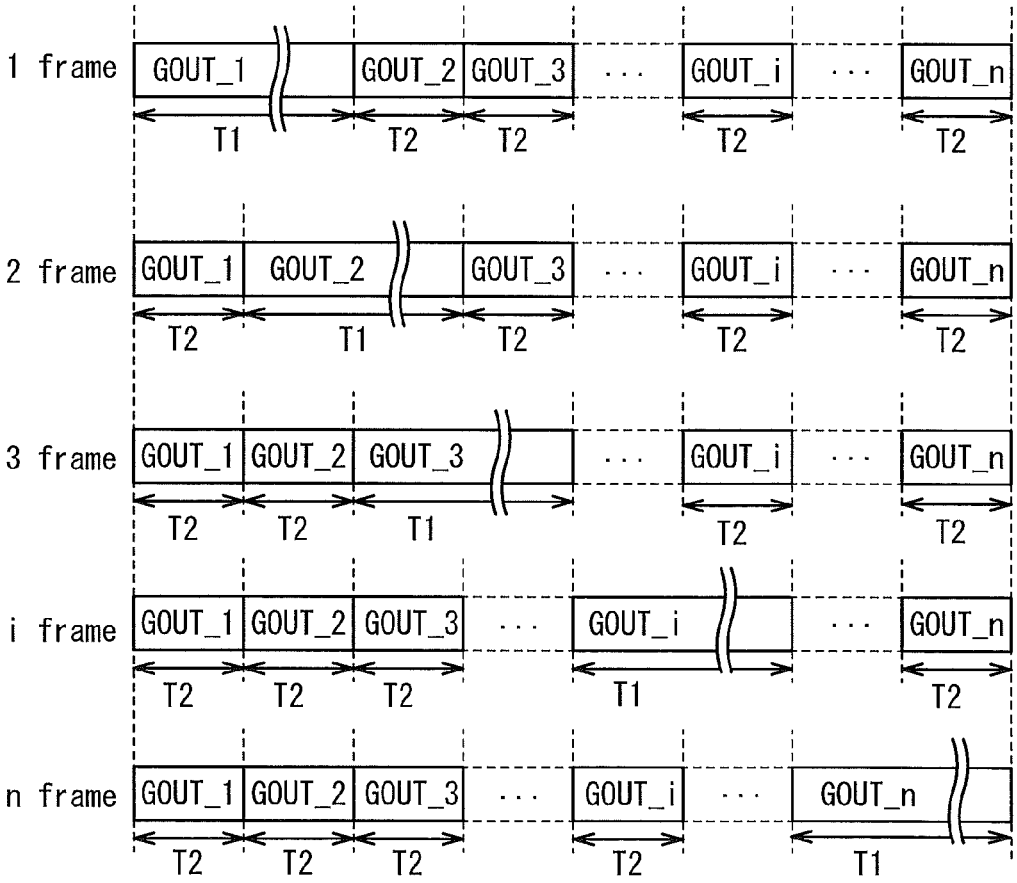

Next, in FIG. 1B, a period in which pixels are selected by GOUT_1 to GOUT_n each of which serves as the scan line 101 in FIG. 1A is schematically illustrated. FIG. 1B shows part of a plurality of frame periods for image display and shows a first frame period to an n frame period sequentially. For example, in the first frame period, GOUT_1 selects pixels in a first selection period T1, GOUT_2 selects pixels in a second selection period T2, and then GOUT_n which is in the final row selects pixels in the second selection period T2. The length of each of the first frame period to the n-th frame period is substantially the same as the sum of selection periods of the scan lines 101 in the first to the n-th rows.

Note that each of periods for selecting pixels by GOUT_1 to GOUT_n each of which serves as the scan line 101 is a period in which the source and the drain of the transistor 104 are brought into conduction state by supply of a high-level potential to the scan line 101. In contrast, in a non-selection period which is a period other than the selection period, a low-level potential is supplied to the scan line 101 and then the source and the drain of the transistor 104 are brought into a non-conduction state.

In FIG. 1B, as described above, in the first frame period, the pixels connected to the scan line GOUT_1 in the first row (also referred to as a first scan line) are selected in the first selection period T1, and the pixels connected to the scan lines in rows other than the first row are selected in the second selection period T2. Similarly, in the second frame period, the pixels connected to the scan line GOUT_2 in the second row (also referred to as a second scan line) are selected in the first selection period T1, and the pixels connected to the scan lines in the rows other than the second row a,e selected in the second selection period T2. Similarly, in the i-th frame period, the pixels connected to the scan line GOUT_i in the i-th row (also referred to as an i-th scan line) are selected in the first selection period T1, and the pixels connected to the scan lines in the rows other than the i-th row are selected in the second selection period T2. Similarly, in the n-th frame period, the pixels connected to the scan line GOUT_n in the n-th row (also referred to as an n-th scan line) are selected in the first selection period T1, and the pixels connected to the scan lines in the rows other than the n-th row are selected in the second selection period T2.

In other words, in one frame period, a selection period of a scan line in a row is the first selection period T1 and a selection period of scan lines in the other rows is the second selection period T2. Accordingly, the length of one frame period which is the sum of the selection periods of the scan lines 101 in the first to the n-th rows is the same among the first to the n-th frame periods.

Figure 2A:
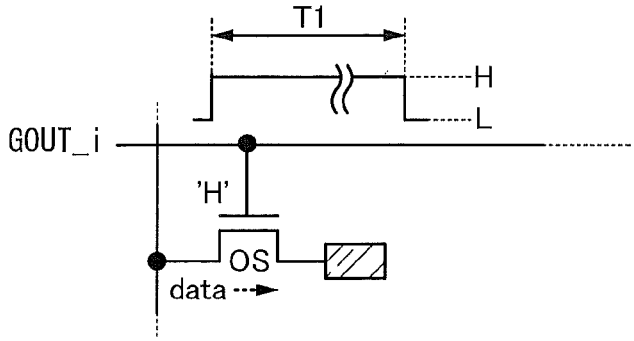
FIGS. 2A to 2C are diagrams illustrating Embodiment 1.
Figure 2B:
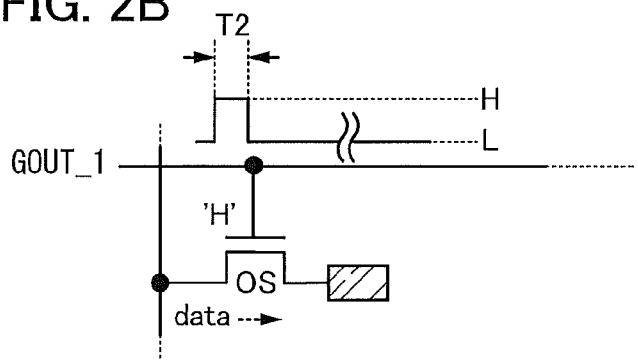

As a specific example, as shown in FIG. 2A, the first selection period T1 is a period in which a high-level potential is applied to the gate of the transistor and the length of the period is 1 millisecond or longer. In the first selection period T1, an image signal data is supplied from the signal line to the display element. Further, as shown in FIG. 2B, the second selection period T2 is a period in which the high-level potential is applied to the gate of the transistor and the length of the period is approximately several microseconds. In the second selection period T2, the image signal data is supplied from the signal line to the display element. Furthermore, as shown in FIG. 2C, the length of one frame period is the same as the sum of the first selection period T1 and the second selection periods T2 of GOUT_1 to GOUT_n each of which serves as the scan line 101.

With the configuration of this embodiment, as shown in FIG. 1B, the scan lines are driven so as to insert the first selection period T1 to each of the plurality of frame periods. Further, a voltage of 20 V or higher is applied to a gate of a transistor in each row, whose threshold voltage is changed by application of negative bias to the gate of the transistor, for 1 millisecond or longer, so that the change in threshold voltage can be cancelled. As a result, characteristics of a transistor including an oxide semiconductor as a semiconductor layer can approximately be recovered to characteristics before deterioration.

Figure 2C:
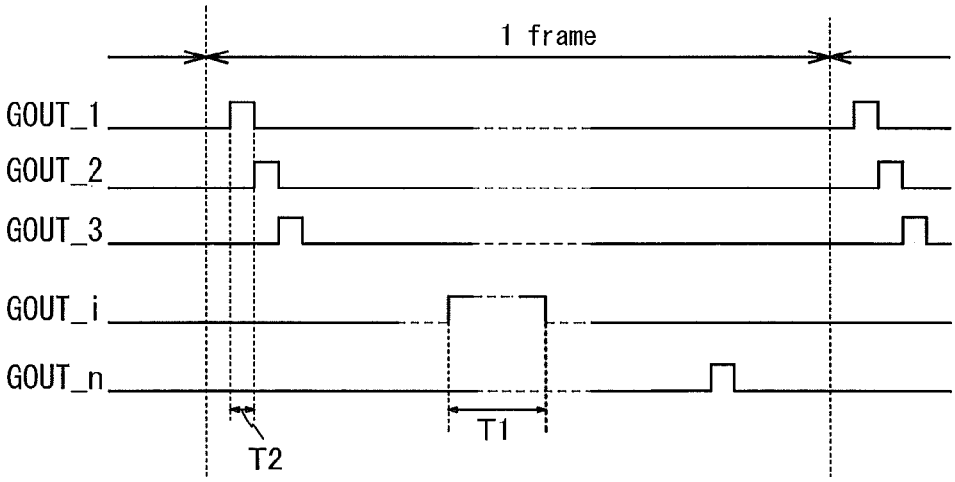
Figure 3A:
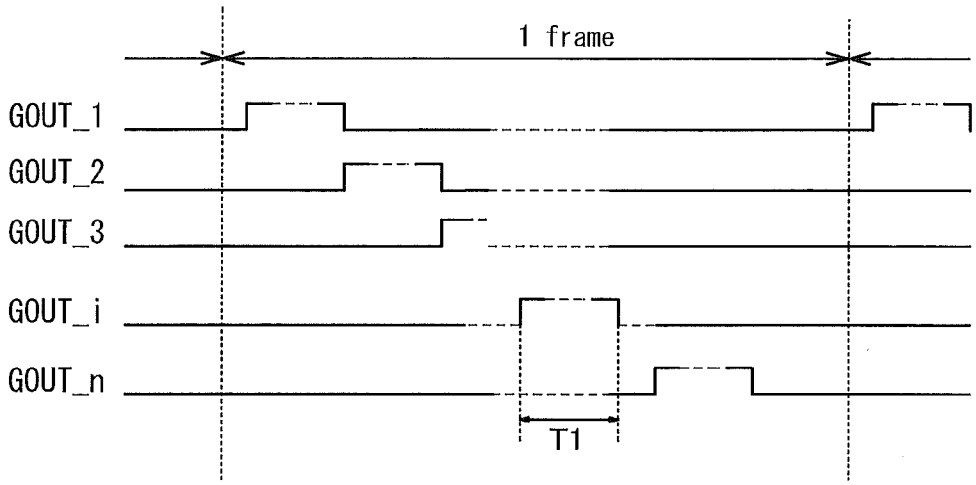
FIGS. 3A and 3B are diagrams illustrating Embodiment 1.
Figure 3B:
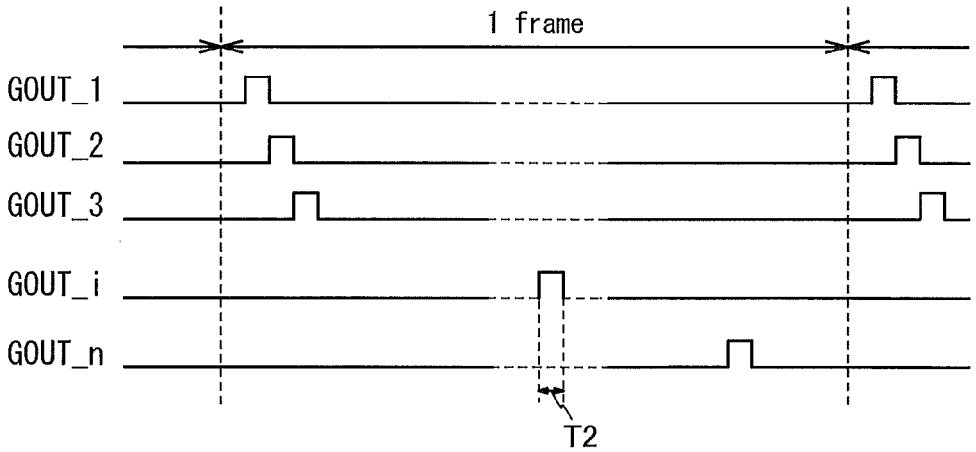

For comparison with the diagram in FIG. 2C, FIGS. 3A and 3B show a driving method of GOUT_1 to GOUT_n each of which serves as the scan line 101 with only the first selection periods T1 and a driving method with only the second selection periods T2, respectively.

In a structure shown in FIG. 3A, the length of one frame period is the sum of the first selection periods T1 of GOUT_1 to GOUT_n each of which serves as the scan line 101. Therefore, when the first selection periods T1 each of which needs 1 millisecond or longer are summed up, the length of one frame period is long; thus, moving image display which uses a plurality of frame periods, or the like becomes difficult to perform.

In a structure shown in FIG. 3B, the length of one frame period is decided as the sum of the second selection periods T2 of GOUT_1 to GOUT_n each of which serves as the scan line 101. Therefore, in the case where display is performed at 60 frames per second, one frame period is 16.6 milliseconds; even if the second selection periods T2 each of which needs approximately several microseconds are summed up, the length of the piled periods is not longer than the length of the frame period. However, with the above driving method, a driving method in which a voltage of 20 V or higher is applied to gates of the transistors for 1 millisecond or longer, or the like becomes difficult to be realized.

With the structure of this embodiment, as described with reference to FIG. 1B and FIG. 2C, moving image display or the like does not become difficult because the scan lines are driven so as to insert the first selection period T1 to each of the plurality of frame periods. Further, the change in threshold voltage can be cancelled in the following manner: a voltage of 20 V or higher is applied to a gate of a transistor in each row, whose threshold voltages are changed by application of negative bias to the gate of the transistor, for 1 millisecond or longer. As a result, characteristics of a transistor including an oxide semiconductor as a semiconductor layer can approximately be recovered to characteristics before deterioration.

Figure 4A:
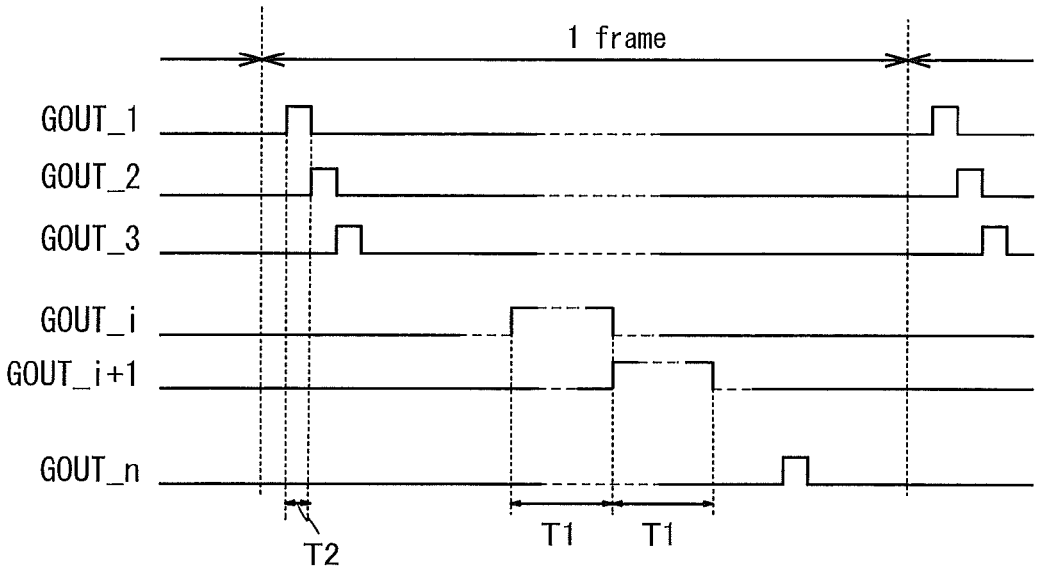
FIGS. 4A and 4B are diagrams illustrating Embodiment 1.
Figure 4B:
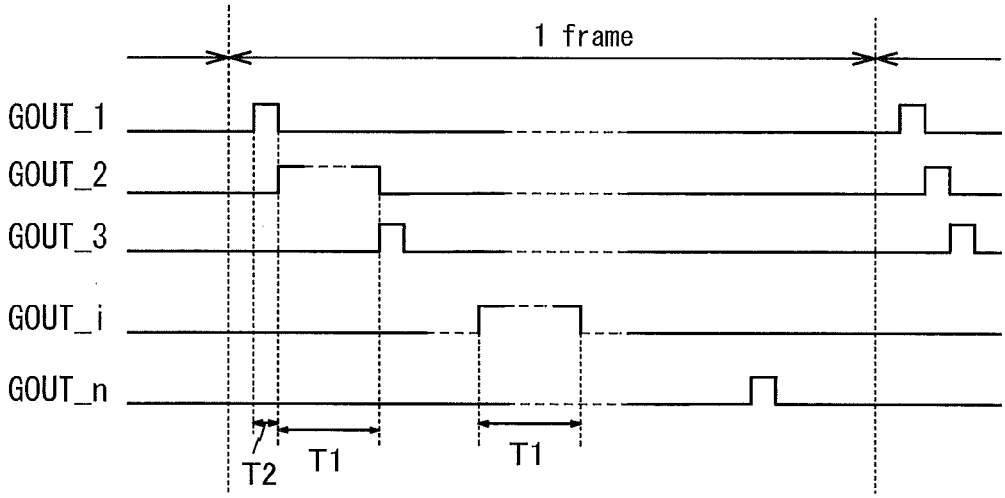

Note that driving of a scan line as described with reference to FIG. 1B and FIG. 2C in which the first selection period T1 is inserted to each of the plurality of frame periods can also be performed on not only one of GOUT_1 to GOUT_n each of which serves as the scan line 101, but also two or more of GOUT_1 to GOUT_n, within one frame period. Specifically, as shown in FIG. 4A, in one frame period, GOUT_i and GOUT_i+1 which serve as the scan lines 101 may each have the first selection period T1. Further, such scan lines are not limited to adjacent scan lines as shown in FIG. 4A. As shown in FIG. 4B, GOUT_2 and GOUT_i which serve as the scan lines 101 and are in rows alienated with each other may each have the first selection period T1. In the case of FIG. 4B, flickers due to selection in the first selection periods T1 can be reduced in comparison with the case of FIG. 4A.

What is described in this embodiment with reference to each drawing can be freely combined with or replaced with what is described in other embodiments as appropriate.

(Embodiment 2)

In this embodiment, a configuration example of a liquid crystal display device including a liquid crystal element as the display element in Embodiment 1 is illustrated and a method for driving a liquid crystal display device at the time of inversion driving is described.

Figure 5A:
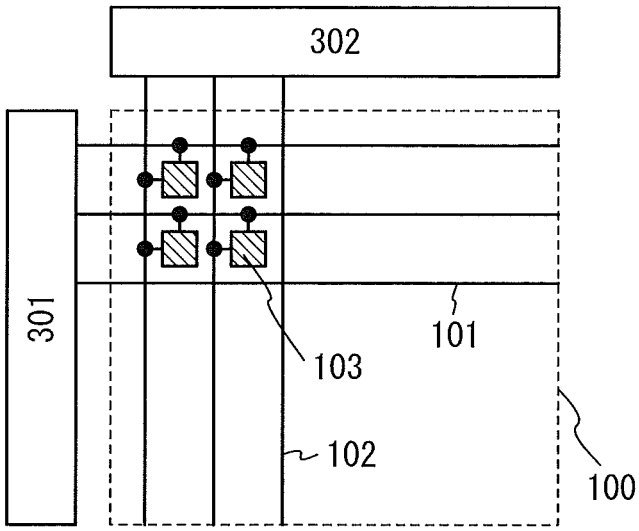
FIGS. 5A and 5B are diagrams illustrating Embodiment 2.

First, FIG. 5A illustrates the configuration of the liquid crystal display device. The liquid crystal display device in FIG. 5A includes the display portion 100 including the plurality of pixels 103, a scan line driver circuit 301, a signal line driver circuit 302, n scan lines 101 whose potentials are controlled by the scan line driver circuit 301, and in signal lines 102 whose potentials are controlled by the signal line driver circuit 302.

Figure 5B:
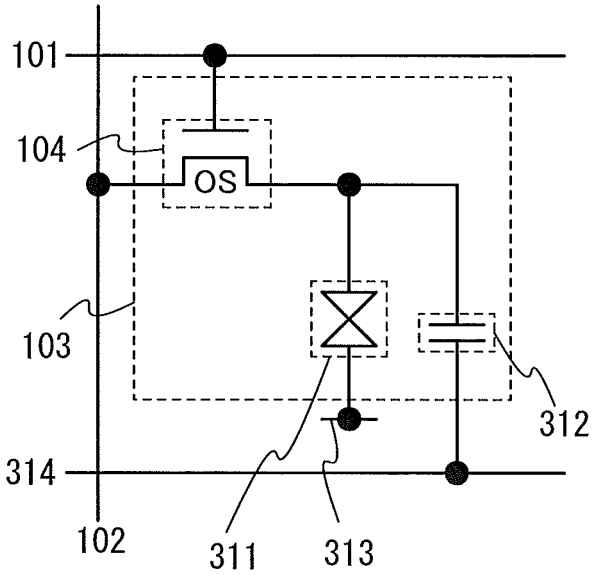

FIG. 5B illustrates an example of a circuit configuration of the pixel 103 included in the liquid crystal display device illustrated in FIG. 5A. The pixel 103 in FIG. 5B includes the transistor 104, a capacitor 312, and a liquid crystal element 311. A gate of the transistor 104 is connected to the scan line 101. One of a source and a drain of the transistor 104 is connected to the signal line 102. One electrode of the capacitor 312 is connected to the other of the source and the drain of the transistor 104. The other electrode of the capacitor 312 is connected to a wiring 314 (also referred to as a capacitor wiring) supplying a capacitor potential. One electrode (also referred to as a pixel electrode) of the liquid crystal element 311 is connected to the other of the source and the drain of the transistor 104 and the one electrode of the capacitor 312. The other electrode (also referred to as a counter electrode) of the liquid crystal element 311 is connected to a wiring 313 supplying a counter potential.

Note that the transistor 104 is an n-channel transistor. The capacitor potential and the counter potential can be the same potential.

Figure 6:
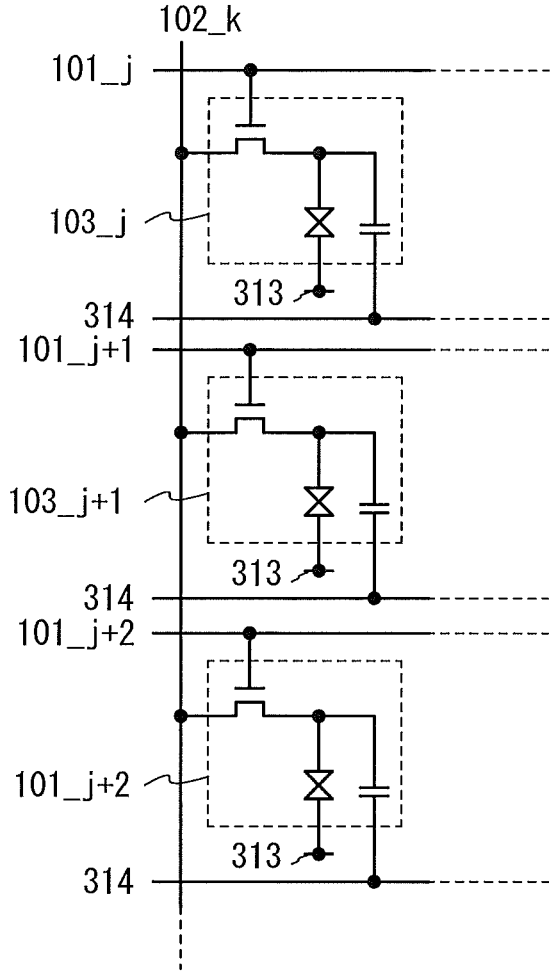
FIG. 6 is a diagram illustrating Embodiment 2.

Next, FIG. 6 illustrates circuit diagrams of the pixels 103 each illustrated in FIG. 5B, which are arranged along the extended signal line. FIG. 6 illustrates the scan line 101_j (j is a natural number of n or less), the scan line 101*j*+1, the scan line 101_j+2, and the signal line 102_k (k is a natural number of in or less). Further, in FIG. 6, the pixel 103_j, the pixel 103_j+1, and the pixel 103_j+2 are illustrated as a pixel connected to the scan line 101_j (j is a natural number of n or less) and the signal line 102_k, a pixel connected to the scan line 101*j*+1 (j is a natural number of n or less) and the signal line 102_k, and a pixel connected to the scan line 101_j+2 (j is a natural number of n or less) and the signal line 102_k, respectively. Note that a display element of each pixel is a liquid crystal element.

Figure 7A:
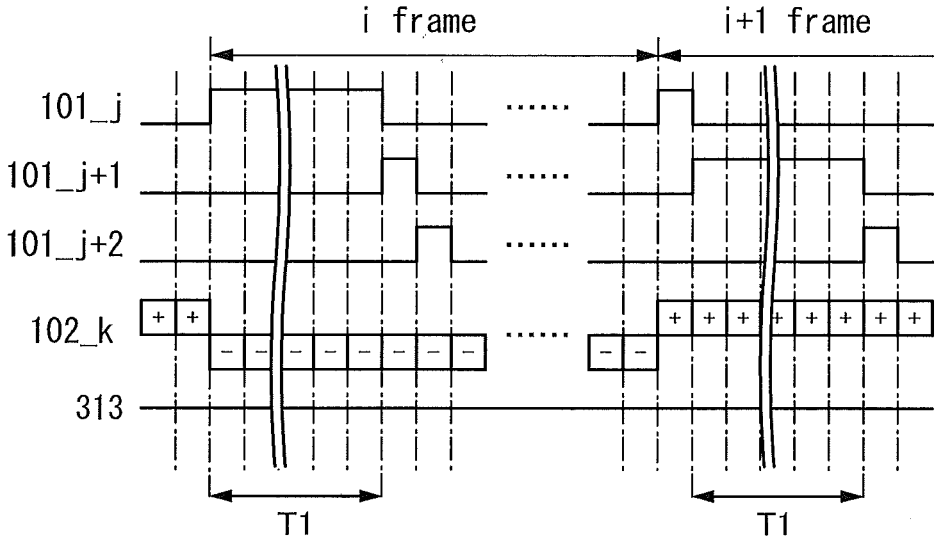
FIGS. 7A and 7B are diagrams illustrating Embodiment 2.

FIG. 7A shows a timing diagram in the case where the circuit shown in FIG. 6 is driven by the method described in Embodiment 1. In FIG. 7A, a selection signal transmitted to the scan line 101_j in the i-th frame is the first selection signal T1, and a selection signal transmitted to the scan line 101_j+1 in the (i+1)th frame is the first selection signal T1. Note that in the i-th frame and the (i+1)th frame, a scan line is driven in the second selection period T2 which is other than the first selection period T1.

Further in FIG. 7A, what is called frame inversion driving in which a voltage applied to a liquid crystal element is inverted every frame so that the polarity (in the diagram, denoted by "+" and "−") of an image signal supplied to the signal line 102_k is opposite to each other in the i-th frame and the (i+1)th frame. Note that in FIG. 7A, the potential of a wiring supplied with the counter potential is also illustrated. A constant potential is supplied to the wiring here; however, the potential can be changed appropriately in accordance with inversion driving.

With the structure of this embodiment, as illustrated in FIG. 7A, moving image display or the like does not become difficult because the scan lines are driven so as to insert the first selection signal T1 to each of the plurality of frame periods. Further, the change in threshold voltage can be cancelled in the following manner: a voltage of 20 V or higher is applied to a gate of a transistor in each row, whose threshold voltages are changed by application of negative bias to the gate of the transistor, for 1 millisecond or longer. As a result, characteristics of a transistor including an oxide semiconductor as a semiconductor layer can approximately be recovered to characteristics before deterioration.

Figure 7B:
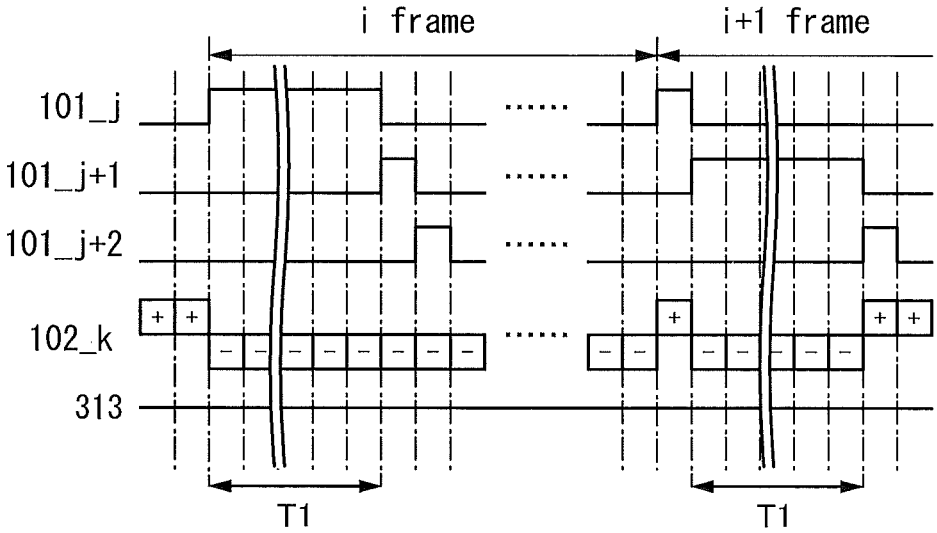

Note that in the first selection period T1, the polarity of the image signal supplied to the signal line 102_k can be a low-level potential regardless of the polarity of the image signal in inversion driving. FIG. 7B shows a specific timing diagram. As illustrated in FIG. 7B, in the case of the polarity of the image signal which becomes a high-level potential in the (i+1)th frame, the polarity of the image signal becomes a low-level potential when the scan line 101_j+1 has a high-level potential due to the first selection signal T1. With the method, the level of negative bias at the time of being applied to the gate of the transistor can be high; therefore, the change in threshold voltage of the transistors in each row, whose threshold voltages are changed, can be cancelled more effectively.

In FIGS. 7A and 7B, an example of the frame inversion driving is described. Note that gate line inversion driving, source line inversion driving, or dot inversion driving not illustrated can be performed.

This embodiment can be implemented in appropriate combination with the structures described in the other embodiments.

(Embodiment 3)

In this embodiment, a block diagram of a display device which can realize the driving method described in the above embodiments is illustrated.

Figure 8:
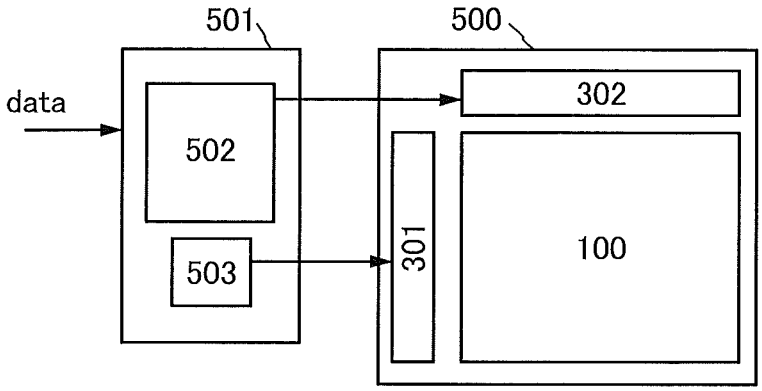
FIG. 8 is a diagram illustrating Embodiment 3.

The block diagram in FIG. 8 illustrates an element substrate 500 and a display control circuit 501.

The element substrate 500 shown in the block diagram in FIG. 8 includes the scan line driver circuit 301, the signal line driver circuit 302, and the display portion 100.

An image signal (data in FIG. 8) is input from the outside to the display control circuit 501 shown in the block diagram in FIG. 8. In addition, the display control circuit 501 includes a clock generation circuit 502 which generates a clock signal for driving the scan line driver circuit 301 and the signal line driver circuit 302, and a pulse width control circuit 503 for controlling a pulse width of the clock signal output to the scan line driver circuit 301.

Note that, the scan line driver circuit 301 and the signal line driver circuit 302 are not necessarily provided over the element substrate 500 same as the display portion 100.

The clock generation circuit 502 is a circuit which outputs a clock signal at a predetermined frequency and drives the scan line driver circuit 301 and the signal line driver circuit 302. Further, the pulse width control circuit 503 is a circuit which controls a pulse width of the clock signal so that a first selection signal is output to each row every frame of the scan line driver circuit 301. Specifically, in a period for outputting the first selection signal T1, the pulse width of a clock signal output to the scan line driver circuit 301 is controlled so that the clock signal holds a high-level potential.

Note that as described in the above embodiments, circuit configurations other than the configuration in this embodiment can be used as long as the circuit can switch the first selection signal T1 and the second selection signal T2 every frame period and output the first selection signal T1 and the second selection signal T2 as described in this embodiment.

This embodiment can be implemented in appropriate combination with the structures described in the other embodiments.

(Embodiment 4)

In this embodiment, an element substrate including a liquid crystal element is described. Note that the element substrate including a liquid crystal element which is described in this embodiment is referred to as a liquid crystal display device.

Figure 9B:
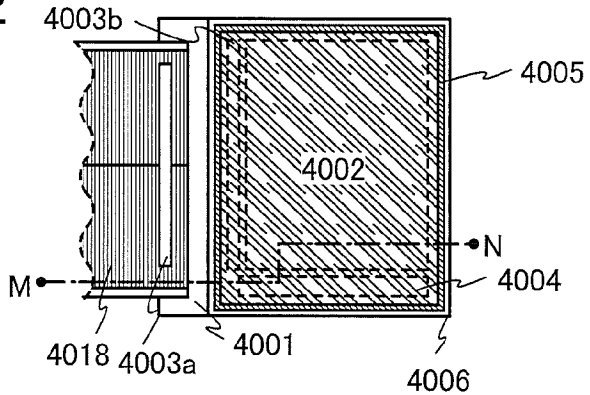
Figure 9B:
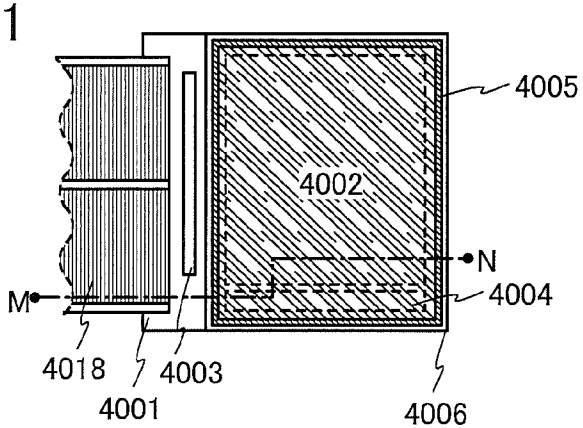
Figure 9B:
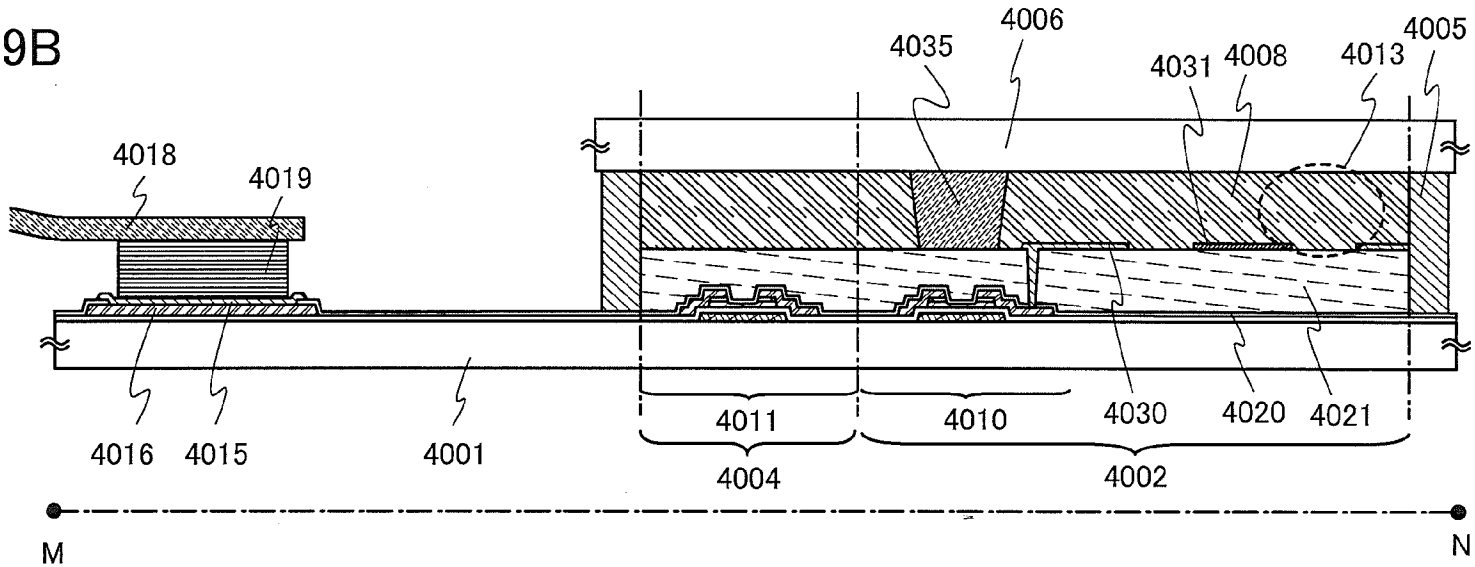

The appearance and a cross section of an element substrate of a liquid crystal display device are described with reference to FIGS. 9A1, 9A2, and 9B. FIGS. 9A1 and 9A2 are top views of panels in which transistors 4010 and 4011 and a liquid crystal element 4013 which are formed over a first substrate 4001 are sealed between the first substrate 4001 and a second substrate 4006 with a sealant 4005. FIG. 9B is a cross-sectional view taken along line M-N in FIGS. 9A1 and 9A2.

The sealant 4005 is provided so as to surround a pixel portion 4002 and a scan line driver circuit 4004 which are provided over the first substrate 4001. In addition, the second substrate 4006 is provided over the pixel portion 4002 and the scan line driver circuit 4004. The pixel portion 4002 and the scanning line driver circuit 4004 are sealed together with a liquid crystal layer 4008, by the first substrate 4001, the sealant 4005, and the second substrate 4006.

In FIG. 9A1, a signal line driver circuit 4003 that is formed using a single crystal semiconductor film or a polycrystalline semiconductor film over a substrate separately prepared is mounted in a region that is different from the region surrounded by the sealant 4005 over the first substrate 4001. FIG. 9A2 illustrates an example in which part of a signal line driver circuit is formed over the first substrate 4001 with the use of a thin film transistor which includes an oxide semiconductor. A signal line driver circuit 4003*b* is formed over the first substrate 4001 and a signal line driver circuit 4003*a* which is formed using a single crystal semiconductor film or a polycrystalline semiconductor film is mounted on the substrate separately prepared.

Note that there is no particular limitation on the connection method of a driver circuit which is separately formed, and a COG method, a wire bonding method, a TAB method, or the like can be used. FIG. 9A1 illustrates an example in which the signal-line driver circuit 4003 is mounted with a COG method, and FIG. 9A2 illustrates an example in which the signal-line driver circuit 4003 is mounted with a TAB method.

Each of the pixel portion 4002 and the scan-line driver circuit 4004 which are provided over the first substrate 4001 includes a plurality of transistors. In FIG. 9B, the transistor 4010 included in the pixel portion 4002 and the transistor 4011 included in the scan-line driver circuit 4004 are illustrated as an example. Insulating layers 4020 and 4021 are provided over the transistors 4010 and 4011.

The transistors 4010 and 4011 are transistors in each of which a semiconductor layer is formed using an oxide semiconductor film as Embodiment 1.

In addition, a pixel electrode layer 4030 and a common electrode layer 4031 are provided over the first substrate 4001, and the pixel electrode layer 4030 is electrically connected to the transistor 4010. The liquid crystal element 4013 includes the pixel electrode layer 4030, the common electrode layer 4031, and the liquid crystal layer 4008.

In a liquid crystal display device including the liquid crystal layer 4008 which exhibits a blue phase, a method in which the gray scale is controlled by generating an electric field generally parallel (i.e., in a horizontal direction) to a substrate to move liquid crystal molecules in a plane parallel to the substrate can be used. For such a method, an electrode structure used in an in plane switching (IPS) mode illustrated in FIGS. 9A1, 9A2, and 9B is employed in this embodiment. Note that without limitation to an IPS mode, an electrode structure used in a fringe field switching (FFS) mode can also be employed. Note that in particular, a structure using a liquid crystal layer which exhibits a blue phase needs alignment control with high application voltage. Such a structure is preferable for performing the following method for driving a display device, which is described in Embodiment 1: a voltage of 20 V or higher is applied to gates of the transistors, whose threshold voltages are changed by application of negative bias to the gates, for 1 millisecond or longer, whereby the transistor has a threshold voltage that is substantially the same as the threshold voltage before the change.

As the first substrate 4001 and the second substrate 4006, glass, plastic, or the like having a light-transmitting property can be used. Polyether sulfone (PES), polyimide, a fiberglass-reinforced plastic (FRP) plate, a polyvinyl fluoride (PVF) film, a polyester film, or an acrylic resin film can be used as plastic. In addition, a sheet with a structure in which an aluminum foil is sandwiched between PVF films or polyester films can be used.

Furthermore, a columnar spacer 4035 which is provided in order to control the thickness (a cell gap) of the liquid crystal layer 4008 can be obtained by selective etching of an insulating film. Note that a spherical spacer may be used instead of the columnar spacer 4035.

The transistors 4010 and 4011 may be covered with an insulating layer 4020 serving as a protective film; however, this embodiment is not particularly limited to such a structure.

Note that the protective film is provided to prevent entry of contaminant impurities such as organic substance, metal, or moisture existing in air and is preferably a dense film. The protective film may be formed with a single layer or a stacked layer of a silicon oxide film, a silicon nitride film, a silicon oxynitride film, a silicon nitride oxide film, an aluminum oxide film, an aluminum nitride film, an aluminum oxynitride film, and/or an aluminum nitride oxide film by sputtering.

After the protective film is formed, the semiconductor layer may be subjected to annealing (300° C. to 400° C.).

The pixel electrode layer 4030 and the common electrode layer 4031 can be made of a light-transmitting conductive material such as indium oxide containing tungsten oxide, indium zinc oxide containing tungsten oxide, indium oxide containing titanium oxide, indium tin oxide containing titanium oxide, indium tin oxide (ITO), indium zinc oxide, or indium tin oxide to which silicon oxide is added.

A conductive composition containing a conductive high molecule (also referred to as a conductive polymer) can be used for the pixel electrode layer 4030 and the common electrode layer 4031.

Further, a variety of signals and a potential are supplied to the signal line driver circuit 4003 which is formed separately, the scan line driver circuit 4004, and the pixel portion 4002 from an FPC 4018.

Further, since the transistor is easily broken by static electricity and the like, a protection circuit for protecting the driver circuits is preferably provided over the same substrate for a gate line or a source line. The protective circuit is preferably formed with a non-linear element including an oxide semiconductor.

In FIGS. 9A1, 9A2, and 9B, a connecting terminal electrode 4015 is formed using the same conductive film as that of the pixel electrode layer 4030, and a terminal electrode 4016 is formed using the same conductive film as that of source and drain electrode layers of the transistors 4010 and 4011.

The connection terminal electrode 4015 is electrically connected to a terminal included in the FPC 4018 through an anisotropic conductive film 4019.

Although FIGS. 9A to 9B illustrate an example in which the signal line driver circuit 4003 is formed separately and mounted on the first substrate 4001; however, one embodiment of the present invention is not limited to this structure. The scan line driver circuit may be formed separately and then mounted, or only part of the signal line driver circuit or part of the scan line driver circuit may be formed separately and then mounted.

What is described in this embodiment with reference to each drawing can be freely combined with or replaced with what is described in other embodiments as appropriate.

(Embodiment 5)

In this embodiment, a specific example of a method for manufacturing an oxide semiconductor film which is used for a semiconductor layer of the transistor described in Embodiment 4 as well is described.

First, the substrate is held in a film formation chamber which is kept under reduced pressure, and then is heated so that the substrate temperature reaches a temperature higher than or equal to 200° C. and lower than or equal to 500° C., preferably higher than or equal to 300° C. and lower than or equal to 500° C.

Then, a high-purity gas from which impurities such as hydrogen, water, a hydroxyl group, or hydride are sufficiently removed is introduced while moisture remaining in the film formation chamber is removed, and the oxide semiconductor film is formed over the substrate with the use of the above target. To remove moisture remaining in the deposition chamber, an entrapment vacuum pump such as a cryopump, an ion pump, or a titanium sublimation pump is desirably used. Further, an evacuation unit may be a turbo pump provided with a cold trap. In the film formation chamber which is evacuated with the cryopump, for example, impurities such as hydrogen, water, a hydroxyl group, or hydride (preferably, also a compound including a carbon atom) or the like are removed, whereby the concentration of impurities such as hydrogen, water, a hydroxyl group, or hydride in the oxide semiconductor film formed in the film formation chamber can be reduced.

In the case where the substrate temperature is low (for example, 100° C. or lower) during deposition, a substance including a hydrogen atom may enter the oxide semiconductor; thus, it is preferable that the substrate be heated at a temperature in the above range. When the oxide semiconductor film is formed with the substrate heated at the above temperature, the substrate temperature is increased; thus, hydrogen bonds are cut due to heat and the substance including a hydrogen atom is less likely to be taken into the oxide semiconductor film. Therefore, by forming the oxide semiconductor film with the substrate heated at the above temperature, the concentration of impurities such as hydrogen, water, a hydroxyl group, or a hydride in the oxide semiconductor film can be sufficiently reduced. Moreover, damage due to sputtering can be reduced.

As an example of the film formation conditions, the following conditions can be employed: the distance between the substrate and the target is 60 mm, the pressure is 0.4 Pa, the direct-current (DC) power source is 0.5 kW, the substrate temperature is 400° C., and the film formation atmosphere is an oxygen atmosphere (the proportion of the oxygen flow rate is 100%). Note that a pulse direct current power source is preferable because powder substances (also referred to as particles or dust) generated in deposition can be reduced and the film thickness can be uniform.

Note that before the oxide semiconductor film is formed by sputtering, powdery substances (also referred to as particles or dust) attached on a formation surface of the oxide semiconductor film are preferably removed by reverse sputtering in which an argon gas is introduced and plasma is generated. The reverse sputtering refers to a method in which a voltage is applied to a substrate side to generate plasma in the vicinity of the substrate to modify a surface. Note that instead of argon, a gas of nitrogen, helium, oxygen or the like may be used.

Next, the oxide semiconductor film is processed, whereby the island-shaped oxide semiconductor film is formed. The oxide semiconductor film can be processed by being etched after a mask having a desired shape is formed over the oxide semiconductor film.

After that, heat treatment (first heat treatment) may be performed on the oxide semiconductor film. The heat treatment further removes the substance including a hydrogen atom from the oxide semiconductor film; thus, the structure of the oxide semiconductor film can be ordered and defect states in the energy gap can be reduced. The heat treatment is performed under an inert gas atmosphere at greater than or equal to 250° C. and less than or equal to 700° C., preferably greater than or equal to 450° C. and less than or equal to 600° C. or less than a strain point of the substrate. The inert gas atmosphere is preferably an atmosphere which contains nitrogen or a rare gas (e.g., helium, neon, or argon) as its main component and does not contain water, hydrogen, or the like. For example, the purity of nitrogen or a rare gas such as helium, neon, or argon introduced into a heat treatment apparatus is greater than or equal to 6 N (99.9999%), preferably greater than or equal to 7 N (99.99999%) (that is, the concentration of the impurities is less than or equal to 1 ppm, preferably less than or equal to 0.1 ppm).

The heat treatment can be performed in such a way that, for example, an object to be heated is introduced into an electric furnace in which a resistance heating element or the like is used and heated, under a nitrogen atmosphere at 450° C. for 1 hour. The oxide semiconductor film is not exposed to the air during the heat treatment so that entry of water or hydrogen can be prevented.

The impurities are reduced by the heat treatment, leading to an i-type oxide semiconductor film (an intrinsic oxide semiconductor film) or a substantially i-type oxide semiconductor film. Accordingly, a transistor having extremely excellent characteristics can be realized.

The above heat treatment has an effect of removing hydrogen, water, and the like and can be referred to as dehydration treatment, dehydrogenation treatment, or the like. The heat treatment can be performed at the timing, for example, before the oxide semiconductor film is processed to have an island shape or after the gate insulating film is formed. Such dehydration treatment or dehydrogenation treatment may be conducted once or plural times.

Note that it has been pointed out that an oxide semiconductor is insensitive to impurities, there is no problem when a considerable amount of metal impurities is contained in the film, and therefore, soda-lime glass which contains a large amount of an alkali metal such as sodium and is inexpensive can also be used (Kamiya, Nomura, and Hosono, "Carrier Transport Properties and Electronic Structures of Amorphous Oxide Semiconductors: The present status", *KOTAI BUTSURI* (*SOLID STATE PHYSICS*), 2009, Vol. 44, pp. 621-633). But such consideration is not appropriate. Alkali metal is not an element included in an oxide semiconductor, and therefore, is an impurity. Also, alkaline earth metal is also impurity in the case where alkaline earth metal is not included in an oxide semiconductor. Alkali metal, in particular, Na becomes $Na^+$ when an insulating film in contact with the oxide semiconductor film is an oxide and Na diffuses into the insulating layer. In addition, in the oxide semiconductor film, Na cuts or enters a bond between metal and oxygen which are included in an oxide semiconductor. As a result, for example, deterioration in characteristics of the transistor, such as a normally-on state of the transistor due to shift of a threshold voltage in the negative direction, or reduction in mobility, occurs. In addition, variation in characteristics also occurs. Such deterioration in characteristics of the transistor and variation in characteristics due to the impurity remarkably appear when the hydrogen concentration in the oxide semiconductor film is very low. Such deterioration in characteristics of the transistor and variation in characteristics due to the impurity remarkably appear when the hydrogen concentration in the oxide semiconductor film is very low. Therefore, when the concentration of hydrogen in the oxide semiconductor film is lower than or equal to $5\times10^{19}/cm^3$, particularly lower than or equal to $5\times10^{18}/cm^3$, the concentration of the above impurity is preferably reduced. Specifically, a measurement value of a Na concentration by secondary ion mass spectrometry is preferably less than or equal to $5\times10^{16}/cm^3$, more preferably less than or equal to $1\times10^{16}/cm^3$, still more preferably less than or equal to $1\times10^{15}/cm^3$. In a similar manner, a measurement value of a Li concentration is preferably less than or equal to $5\times10^{15}/cm^3$, more preferably less than or equal to $1\times10^{15}/cm^3$. In a similar manner, a measurement value of a K concentration is preferably less than or equal to $5\times10^{15}/cm^3$, more preferably less than or equal to $1\times10^{15}/cm^3$.

Note that although the oxide semiconductor film may be amorphous, a crystalline oxide semiconductor film is preferably used for a channel formation region of the transistor. This is because the reliability (resistance to the gate bias stress) of the transistor can be Improved by using the crystalline oxide semiconductor film.

Although the crystalline oxide semiconductor film is preferably in a single-crystal state, an oxide including a crystal with c-axis alignment (also referred to as c axis aligned crystal (CAAC)) is also preferably used.

An oxide semiconductor film including CAAC can be formed by sputtering as well. In order to obtain a film including CAAC by sputtering, it is important to form hexagonal crystals in an initial stage of deposition of an oxide semiconductor film and to cause crystal growth from the hexagonal crystals as cores. In order to achieve this, it is preferable that the distance between the target and the substrate be made to be longer (e.g., 150 mm to 200 mm) and a substrate heating temperature be 100° C. to 500° C., more preferably 200° C. to 400° C., still preferably 250° C. to 300° C. In addition to this, the deposited oxide semiconductor film is subjected to heat treatment at a temperature higher than the substrate heating temperature in the deposition. Therefore, micro-defects in the film and defects at the interface of a stacked layer can be compensated.

In this manner, an oxide semiconductor film can be formed.

What is described in this embodiment with reference to each drawing can be freely combined with or replaced with what is described in other embodiments as appropriate.

(Embodiment 6)

In this embodiment, an example of a plan view and a cross sectional view of a pixel of a liquid crystal display device is described with reference to drawings.

Figure 10A:
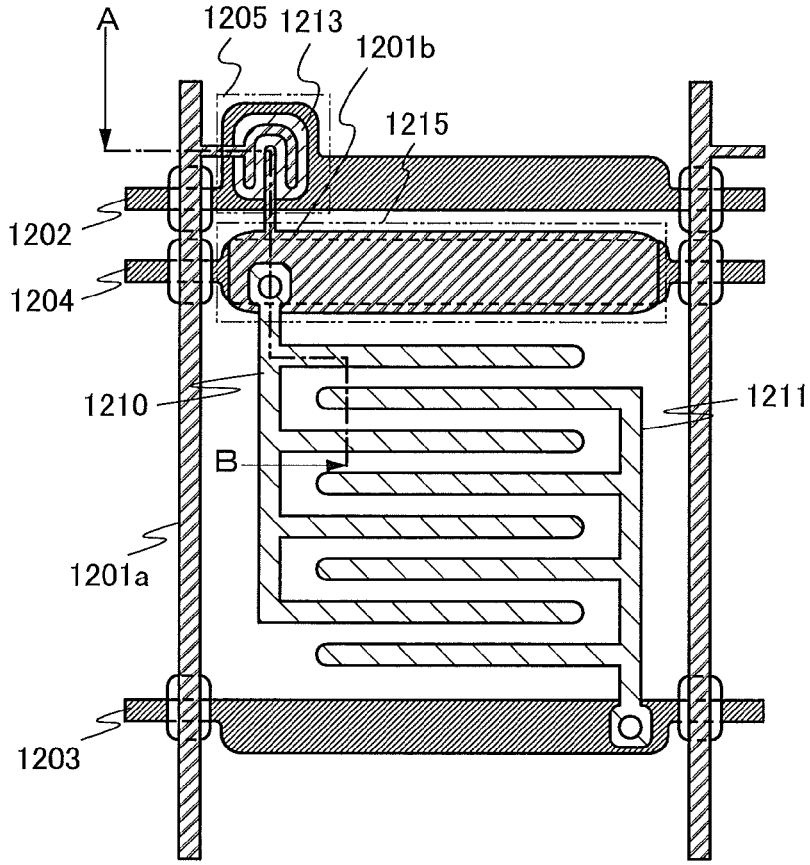
FIGS. 10A and 10B are diagrams illustrating Embodiment 6.
Figure 10B:
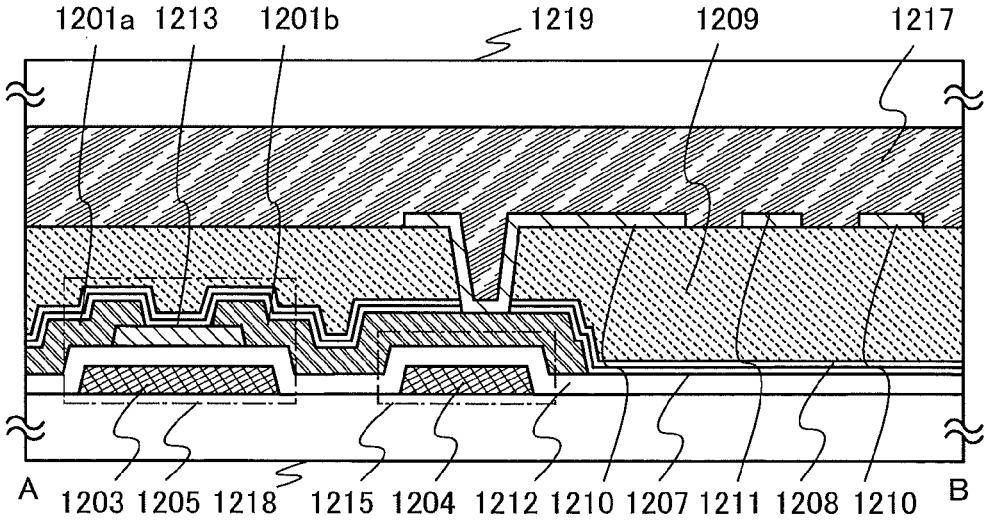

FIG. 10A is a plan view of one of pixels included in a display panel. FIG. 10B is a cross-sectional view taken along the alternate long and short dashed line A-B of FIG. 10A.

In FIG. 10A, wiring layers (including a source electrode layer 1201*a* and a drain electrode layer 1201) which are the signal lines are provided to be extended in a longitudinal direction (a column direction) in the drawing. A wiring layer (including a gate electrode layer 1202) which is a scan line is provided to be extended in a horizontal direction (a row direction) in the drawing. A wiring layer (including an electrode layer 1203) which is a common line scan line is provided to be approximately orthogonal to the source electrode layer 1201*a* (to be extended in a horizontal direction (a row direction)) in the drawing. A capacitor wiring layer 1204 is provided to be extended approximately parallel to the gate electrode layer 1202 and the electrode layer 1203, and approximately orthogonally to the source electrode layer 1201*a*.

In a pixel of the display panel illustrated in FIG. 10A, a transistor 1205 including the gate electrode layer 1202 is provided. An insulating film 1207, an insulating film 1208, and an interlayer film 1209 are formed over the transistor 1205.

The pixel of the display panel illustrated in FIGS. 10A and 10B includes the transparent electrode layer 1210 as a first electrode layer connected to the transistor 1205, and a transparent electrode layer 1211 as a second electrode layer connected to the electrode layer 1203. The transparent electrode layer 1210 and the transparent electrode layer 1211 are formed so that their comb-shapes may be in mesh and so that they may be separated. Openings (contact holes) are formed in the insulating film 1207, the insulating film 1208, and the interlayer film 1209 which are formed over the transistor 1205. The transparent electrode layer 1210 is connected to the transistor 1205 in the opening (contact hole).

The transistor 1205 illustrated in FIGS. 10A and 10B includes a semiconductor layer 1213 provided over the gate electrode layer 1202 with a gate insulating layer 1212 therebetween, and the source electrode layer 1201*a* and the drain electrode layer 1201*b* are in contact with the semiconductor layer 1213. In addition, the capacitor wiring layer 1204, the gate insulating layer 1212, and the drain electrode layer 1201*b* are stacked to form a capacitor 1215.

Further, a first substrate 1218 and a second substrate 1219 are provided so as to overlap with each other with the transistor 1205 and a liquid crystal layer 1217 provided therebetween.

Note that although an example of the case where a bottom-gate inverted staggered transistor is used as the transistor 1205 is illustrated in FIG. 10B, there is no particular limitation on the structure of a transistor applicable to the display device disclosed in this specification. For example, a top-gate transistor in which a gate electrode layer is placed on the upper side of a semiconductor layer with a gate insulating layer interposed therebetween; a bottom-gate staggered transistor or planar transistor in which a gate electrode layer is placed on the lower side of a semiconductor layer with a gate insulating layer interposed therebetween; or the like can be used.

What is described in this embodiment with reference to each drawing can be freely combined with or replaced with what is described in other embodiments as appropriate.

(Embodiment 7)

In this embodiment, examples of electronic devices will be described.

A display device according to any of the above embodiments can be applied to a variety of electronic devices (including an amusement machine). Examples of electronic devices include a television set (also referred to as a television or a television receiver), a monitor of a computer, electronic paper, a camera such as a digital camera or a digital video camera, a digital photo frame, a mobile phone handset (also referred to as a mobile phone or a mobile phone device), a portable game console, a portable information terminal, an audio reproducing device, a large-sized game machine such as a pachinko machine, and the like.

A display device according to embodiment of the display device according to any of the above embodiments can be used in electronic devices in all fields as long as they display information. For example, electronic paper can be applied to an electronic book (e-book) reader, a poster, an advertisement in a vehicle such as a train, displays of various cards such as a credit card, and the like. Examples of the electronic devices are illustrated in FIGS. 11A to 11D.

Figure 11A:
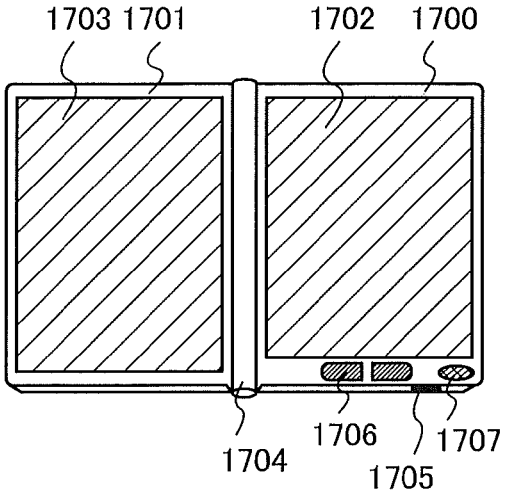
FIGS. 11A to 11D are diagrams illustrating Embodiment 7.

FIG. 11A illustrates an example of an e-book reader. The e-book reader illustrated in FIG. 11A includes two housings, a housing 1700 and a housing 1701. The housing 1700 and the housing 1701 are combined with a hinge 1704 so that the electronic book reader can be opened and closed. With such a structure, the e-book reader can be operated like a paper book.

A display portion 1702 and a display portion 1703 are incorporated in the housing 1700 and the housing 1701, respectively. The display portion 1702 and the display portion 1703 may be configured to display one image or different images. In the case where the display portion 1702 and the display portion 1703 display different images, for example, a display portion on the right side (the display portion 1702 in FIG. 11A) can display text and a display portion on the left side (the display portion 1703 in FIG. 11A) can display graphics.

Figure 11B:
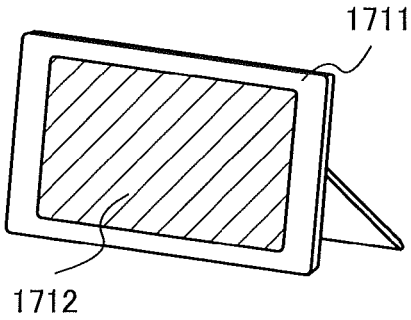

FIG. 11B illustrates an example of a digital photo frame including a display device. For example, in the digital photo frame illustrated in FIG. 11B, a display portion 1712 is incorporated in a housing 1711. The display portion 1712 can display various images. For example, the display portion 1712 can display data of an image taken with a digital camera or the like and function as a normal photo frame.

Figure 11C:
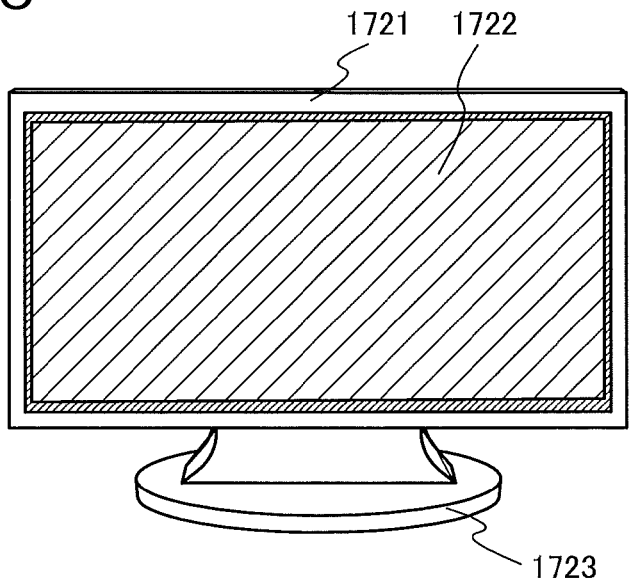

FIG. 11C illustrates an example of a television set including a display device. In the television set illustrated in FIG. 11C, a display portion 1722 is incorporated in a housing 1721. The display portion 1722 can display an image. Further, the housing 1721 is supported by a stand 1723 here. The display device described in any of the above embodiments can be used in the display portion 1722.

Figure 11D:
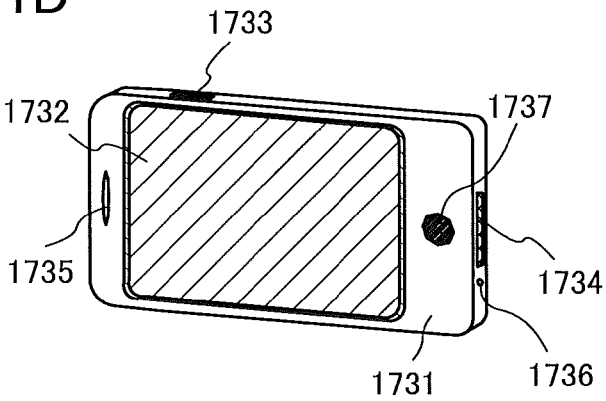

FIG. 11D illustrates an example of a mobile phone including a display device. The mobile phone handset illustrated in FIG. 11D is provided with a display portion 1732 incorporated in a housing 1731, an operation button 1733, an operation button 1737, an external connection port 1734, a speaker 1735, a microphone 1736, and the like.

The display portion 1732 of the mobile phone handset illustrated in FIG. 11D is a touch panel. By touching the display portion 1732 with a finger or the like, contents displayed on the display portion 1732 can be controlled. Further, operations such as making calls and texting can be performed by touching the display portion 1732 with a finger or the like.

What is described in this embodiment with reference to each drawing can be freely combined with or replaced with what is described in other embodiments as appropriate.

Example 1

In this example, a measurement result of the experiment is described in which a condition for applying a positive voltage to a gate of a transistor is changed. The experiment relates to cancellation of the change in threshold voltage of a transistor, which is realized by application of a voltage of 20 V or higher to the gate of the transistor for 1 millisecond or longer. The cancellation is described in Embodiment 1.

The length of time for applying a positive voltage to the gate of the transistor was changed, and photoresponse characteristics before and after light irradiation were measured. Specifically, how results of measuring photoresponse characteristics before and after light irradiation are changed by change in the length of time for applying a positive voltage was examined.

Note that a manufacturing condition of a transistor used for a measurement was as follows.

Figure 12:
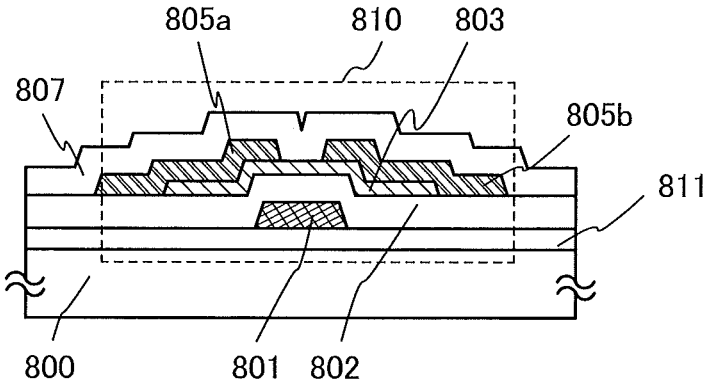
FIG. 12 is a diagram illustrating Example 1.

A transistor used for measurement was an inversion staggered thin film transistor (referred to as a channel etched thin film transistor, which is one of bottom gate structure), as illustrated in FIG. 12. A transistor 810 included the following over a glass substrate 800: a base film 811, a gate electrode 801, a gate insulating layer 802, an oxide semiconductor layer 803, a source electrode layer 805*a*, a drain electrode layer 805*b*, and an insulating layer 807.

The channel length (L) was 30 μm and the channel width (W) was 10000 μm. The source electrode layer 805*a* and the drain electrode layer 805*b* each had a meandering shape. Further, the length of a portion in which the source electrode layer 805*a* and the gate electrode 801 overlapped with each other and the length of a portion in which the drain electrode layer 805*b* and the gate electrode 801 overlapped with each other were not limited.

First, an insulating film which was to be the base film 811 was formed over the glass substrate 800 with an insulation surface. The base film 811 was formed by stacking a 100-nm-thick silicon nitride film and a 150-nm-thick silicon oxynitride film in this order.

Next, the gate electrode 801 was formed over the base film 811. As the gate electrode 801, a single layer of a 100-mn-thick tungsten film was formed. Note that an end portion of the gate electrode 801 had a tapered shape. Here, a taper angle was, for example, greater than or equal to 30° and less than or equal to 60°. The taper angle refers to an inclination angle formed with a side surface and a bottom surface of a layer having a tapered shape (for example, the gate electrode 801) when seen from a direction perpendicular to a cross section (a plane perpendicular to a surface of a substrate) of the layer. Further, the gate insulating layer 802 is formed to cover the gate electrode 801. As the gate insulating layer 802, a single layer of a 100-nm-thick silicon oxynitride film.

Next, an In—Ga—Zn—O film was formed to a thickness of 35 nm by sputtering with the use of an oxide target having a composition ratio of $In_2O_3$:$Ga_2O_3$:ZnO=1:1:2 [molar ratio] over a glass substrate (126.6 mm×126.6 mm) The film formation conditions of the In—Ga—Zn—O film are as follows: the film formation temperature is 200° C., the pressure is 0.6 Pa, and the power is 5 kW.

After that, heat treatment (in a furnace) was performed at 450° C. for 1 hour in a nitrogen atmosphere. This heat treatment is preferably performed in an atmosphere of nitrogen or a rare gas such as helium, neon, or argon in which water, hydrogen, or the like is not contained, for example, the dew point is lower than or equal to −40° C., preferably lower than or equal to −60° C. It is preferable that the purity of nitrogen or the rare gas such as helium, neon, or argon which is introduced into a heat treatment apparatus be set to be 6N (99.9999%) or higher, preferably 7N (99.99999%) or higher (that is, the concentration of impurities is 1 ppm or lower, preferably 0.1 ppm or lower).

After the heat treatment, a layered conductive film was formed by stacking a titanium film with a thickness of 100 nm, an aluminum film with a thickness of 400 nm, and a titanium film with a thickness of 100 nm by sputtering. Next, through a photolithography process, a resist mask is formed over the stack of the conductive films and selective etching is performed to form the source electrode layer 805*a* and the drain electrode layer 805*b*, and then the resist mask is removed. This was followed by heat treatment at 300° C. for 1 hour in a nitrogen atmosphere.

Next, a 400-nm-thick silicon oxide film was formed over the source electrode layer 805*a* and the drain electrode layer 805*b* by sputtering using a silicon oxide target. Note that a condition for forming the silicon oxide film was as follows: a film formation temperature was 200° C., deposition time was 2 minutes, and electric power was 6 kW. After that, heat treatment was performed at 300° C. for 1 hour in a nitrogen atmosphere. FIG. 12 illustrates the transistor 810 manufactured by the above method.

Figure 13:
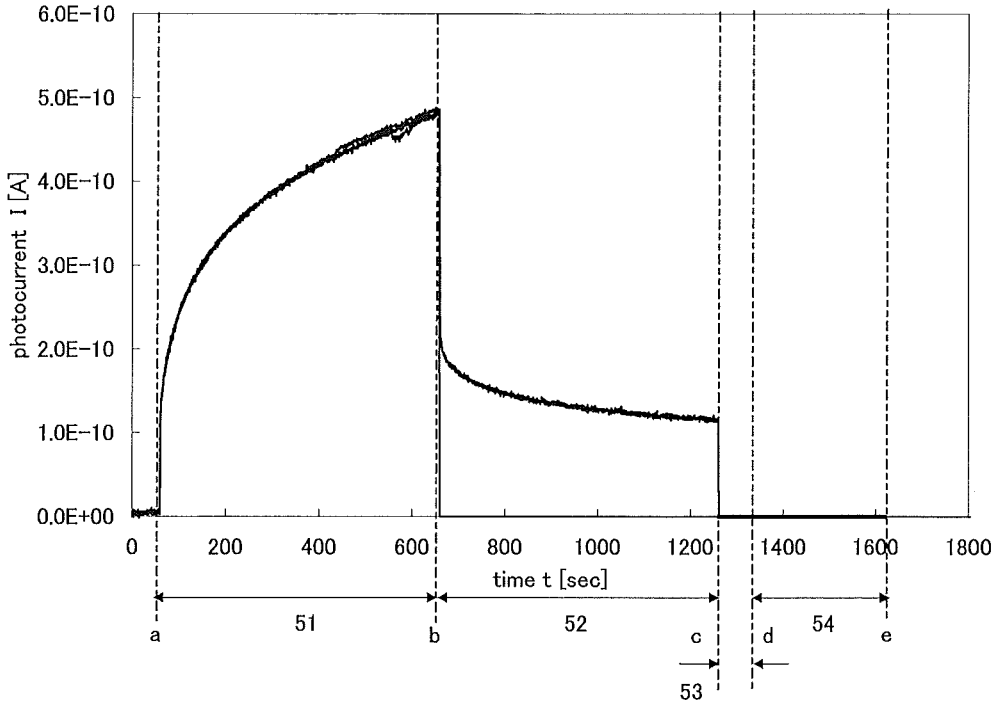
FIG. 13 is a graph illustrating Example 1.

Photoresponse characteristics were measured by using the transistor 810 manufactured by the above method. FIG. 13 shows measurement results of photoresponse characteristics (photocurrent-time characteristics) before and after light irradiation. In a diagram in FIG. 13, a vertical axis shows a photocurrent value and a horizontal axis shows time. Note that as shown in FIG. 13, photoresponse characteristics in a first period 51, a second period 52, a third period 53, and a fourth period 54 are separately described. The first period 51 is a light irradiation period and a period during which voltage is not applied to a gate of a transistor. The second period 52 is a non-light irradiation period and a period during which voltage is not applied to the gate. The third period 53 is a non-light irradiation period and a period during which a positive voltage is applied to the gate. The fourth period 54 is a non-light irradiation period and a period during which voltage is not applied to the gate.

In FIG. 13, "a" denotes a time at which light irradiation starts, "b" denotes a time at which light irradiation stops, "c" denotes a time at which application of a positive voltage starts (non-light irradiation), "d" denotes a time at which application of the positive voltage stops (non-light irradiation), and "e" denotes a time at which measurement is finished.

The first period 51 was 600 seconds, the second period 52 was 600 seconds, and the fourth period 54 was 300 seconds; that is, time from the time a at which light irradiation starts to the time e at which measurement was finished was 1620 seconds. In the first period 51, light irradiation was performed from the side of the transistor 810 to be measured in which light was not blocked, that is, from the direction perpendicular to a substrate surface of the transistor 810. Note that irradiation intensity was 3.5 mW/cm$^2$. A light source was a xenon light source with a wave length of 400 nm, which could emit spectral light as light with a wave length of 400 nm or shorter. Further, a positive voltage was applied in the third period 53. In this example, application of a positive voltage means that as a voltage of 20 V or higher, a voltage of 20 V is applied to the gate of the transistor 810 to be measured, here. Note that when a positive voltage was applied to the gate of the transistor 810 to be measured, a voltage of 0 V was applied to a source and a drain of the transistor.

Photoresponse characteristics were measured by using the transistor 810. The measurement was performed while the third period 53 in FIG. 13 which was the time for applying a positive voltage was changed in six stages: 500 milliseconds, 100 milliseconds, 10 milliseconds, 1 millisecond, 100 microseconds, and 10 microseconds. FIGS. 14A to 14F show the measurement results of photoresponse characteristics before and after light irradiation with the six application times: 500 milliseconds, 100 milliseconds, 10 milliseconds, 1 millisecond, 100 microseconds, and 10 microseconds.

As shown in FIGS. 14A to 14F, photocurrent after application of a positive voltage can be decreased in the range where application time is from 500 milliseconds to 10 microseconds. That is to say, it was confirmed that application of a positive voltage to a gate of a transistor can approximately recover characteristics to characteristics before deterioration, which is increase in photocurrent, by light irradiation. In particular, it could be confirmed that increase in photocurrent due to light irradiation which is deterioration in characteristics can approximately be recovered to characteristics before deterioration in the case where a voltage of 20 V or higher is applied to a gate of a transistor whose threshold voltage is changed by application of negative bias to the gate of the transistor, for 1 millisecond or longer.

This application is based on Japanese Patent Application serial no. 2010-248017 filed with Japan Patent Office on Nov. 5, 2010, the entire contents of which are hereby incorporated by reference.

What is claimed is:

1. A method for driving a display device comprising a first pixel, a second pixel, a third pixel, a first scan line electrically connected to the first pixel, a second scan line electrically connected to the second pixel, and a third scan line electrically connected to the third pixel, the method comprising the steps of:

supplying a first voltage to the first scan line, a second voltage to the second scan line, and the second voltage to the third scan line in a first selection period of a first frame period;

supplying the first voltage to the second scan line, the second voltage to the first scan line, and the second voltage to the third scan line in a second selection period of the first frame period;

supplying the first voltage to the third scan line, the second voltage to the first scan line, and the second voltage to the second scan line in a third selection period of the first frame period;

supplying the first voltage to the first scan line, the second voltage to the second scan line, and the second voltage to the third scan line in a first selection period of a second frame period;

supplying the first voltage to the second scan line, the second voltage to the first scan line, and the second voltage to the third scan line in a second selection period of the second frame period; and supplying the first voltage to the third scan line, the second voltage to the first scan line, and the second voltage to the second scan line in a third selection period of the second frame period, wherein the first selection period of the first frame period is longer than the second selection period of the first frame period and the third selection period of the first frame period, and wherein the second selection period of the second frame period is longer than the first selection period of the second frame period and the third selection period of the second frame period.

2. The method for driving the display device according to claim 1, wherein the first pixel comprises a first transistor, wherein a gate of the first transistor is electrically connected to the first scan line, and wherein the first transistor comprises an oxide semiconductor.

3. The method for driving the display device according to claim 1, wherein the first voltage is higher than the second voltage.

4. The method for driving the display device according to claim 1, wherein the first voltage is equal to or higher than 20 V.

5. The method for driving the display device according to claim 1, wherein the first selection period of the first frame period is equal or longer than 1 millisecond.

6. The method for driving the display device according to claim 1, wherein the first voltage is equal to or higher than 20 V, and wherein the first selection period of the first frame period is equal or longer than 1 millisecond.

7. The method for driving the display device according to claim 1, wherein the first pixel comprises a first transistor and a first liquid crystal element, wherein a gate of the first transistor is electrically connected to the first scan line, and wherein a first terminal of the first transistor is electrically connected to a first terminal of the first liquid crystal element.

8. The method for driving the display device according to claim 1, wherein the first pixel comprises a first transistor and a first light emitting element, wherein a gate of the first transistor is electrically connected to the first scan line, and wherein a first terminal of the first transistor is electrically connected to a first terminal of the first light emitting element.

9. A method for driving a display device comprising a first pixel, a second pixel, a third pixel, a first scan line electrically connected to the first pixel, a second scan line electrically connected to the second pixel, a third scan line electrically connected to the third pixel, and a signal line electrically connected to the first pixel, the second pixel, and the third pixel, the method comprising the steps of:

supplying a first voltage to the first scan line, a second voltage to the second scan line, the second voltage to the third scan line, and a first image signal to the signal line in a first selection period of a first frame period;

supplying the first voltage to the second scan line, the second voltage to the first scan line, the second voltage to the third scan line, and a second image signal to the signal line in a second selection period of the first frame period;

supplying the first voltage to the third scan line, the second voltage to the first scan line, the second voltage to the second scan line, and a third image signal to the signal line in a third selection period of the first frame period;

supplying the first voltage to the first scan line, the second voltage to the second scan line, the second voltage to the third scan line, and a fourth image signal to the signal line in a first selection period of a second frame period;

supplying the first voltage to the second scan line, the second voltage to the first scan line, the second voltage to the third scan line, and a fifth image signal to the signal line in a second selection period of the second frame period; and supplying the first voltage to the third scan line, the second voltage to the first scan line, the second voltage to the second scan line, and a sixth image signal to the signal line in a third selection period of the second frame period, wherein the first image signal, the second image signal, the third image signal, and the fifth image signal have a first polarity, wherein the fourth image signal and the sixth image signal have a second polarity, wherein the first selection period of the first frame period is longer than the second selection period of the first frame period and the third selection period of the first frame period, and wherein the second selection period of the second frame period is longer than the first selection period of the second frame period and the third selection period of the second frame period.

10. The method for driving the display device according to claim 9, wherein the first pixel comprises a first transistor, wherein a gate of the first transistor is electrically connected to the first scan line, and wherein the first transistor comprises an oxide semiconductor.

11. The method for driving the display device according to claim 9, wherein the first voltage is higher than the second voltage.

12. The method for driving the display device according to claim 9, wherein the first voltage is equal to or higher than 20 V.

13. The method for driving the display device according to claim 9, wherein the first selection period of the first frame period is equal or longer than 1 millisecond.

14. The method for driving the display device according to claim 9, wherein the first voltage is equal to or higher than 20 V, and wherein the first selection period of the first frame period is equal or longer than 1 millisecond.

15. The method for driving the display device according to claim 9, wherein the first pixel comprises a first transistor and a first liquid crystal element, wherein a gate of the first transistor is electrically connected to the first scan line, and wherein a first terminal of the first transistor is electrically connected to a first terminal of the first liquid crystal element.

* * * * *